US006419341B1

(12) United States Patent
Nohata et al.

(10) Patent No.: US 6,419,341 B1
(45) Date of Patent: Jul. 16, 2002

(54) METHOD AND APPARATUS FOR DETECTING THE DISCHARGE STATUS OF INKJET PRINTHEADS

(75) Inventors: Yukio Nohata; Atsushi Saito, both of Yokohama; Takeshi Kohno, Kawasaki; Takashi Ono, Yokosuka; Shinichiro Kohri, Kawasaki; Shigeyuki Sugiyama, Hiratsuka, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/559,456

(22) Filed: Apr. 28, 2000

Related U.S. Application Data

(62) Division of application No. 08/724,480, filed on Oct. 1, 1996, now Pat. No. 6,056,386.

(30) Foreign Application Priority Data

Feb. 10, 1995 (JP) ..... 7-255283
Jun. 3, 1996 (JP) ..... 8-049182

(51) Int. Cl.[7] ..... B41J 2/01
(52) U.S. Cl. ..... 347/19
(58) Field of Search ..... 347/19; 250/573, 250/574

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato | 346/140 R |
| 4,459,600 A | | 7/1984 | Sato | 346/140 R |
| 4,463,359 A | | 7/1984 | Ayata | 346/1.1 |
| 4,558,333 A | | 12/1985 | Sugitani | 346/140 R |
| 4,562,445 A | | 12/1985 | Rich | 346/140 R |
| 4,580,150 A | | 4/1986 | Tazkai | 347/43 |
| 4,608,577 A | | 8/1986 | Hori | 346/140 R |
| 4,709,246 A | | 11/1987 | Piatt | 346/140 R |
| 4,723,129 A | | 2/1988 | Endo | 346/1.1 |
| 4,740,796 A | | 4/1988 | Endo | 346/1.1 |
| 4,872,027 A | | 10/1989 | Buskirk et al. | 347/19 |
| 4,922,270 A | | 5/1990 | Cobbs | 346/140 R |
| 5,030,317 A | | 7/1991 | Noguchi | 156/630 |
| 5,124,720 A | * | 6/1992 | Schantz | 347/19 |
| 5,371,531 A | | 12/1994 | Rezanka et al. | 347/43 |
| 5,434,430 A | | 7/1995 | Stewart | 342/573 |

(List continued on next page.)

FOREIGN PATENT DOCUMENTS

| | | |
|---|---|---|
| EP | 622239 | 11/1994 |
| EP | 650848 | 5/1995 |
| JP | 54-056847 | 5/1979 |
| JP | 59-123670 | 7/1984 |
| JP | 59-138461 | 8/1984 |
| JP | 60-071260 | 4/1985 |
| JP | 62-253457 | 11/1987 |
| JP | 4-7159 | 1/1992 |

*Primary Examiner*—Craig A. Hallacher
(74) *Attorney, Agent, or Firm*—Fitzpatrick, Cella, Harper & Scinto

(57) ABSTRACT

Printer performs accurate ink-discharge status detection, dependent upon the type of a printhead attached to the printer, the print mode and the color of ink change, and a facsimile apparatus using the printer. Each time printing based on received facsimile image data for one page of print sheet has been completed, the printhead is moved to a position close to a photosensor, and test ink discharge is performed. At this time, the type of printhead is determined, and whether or not the color printhead is in normally-dischargeable status is judged by comparing a pulsewidth obtained from output from the photosensor with a threshold value selected in accordance with the discrimination result. Otherwise, one of a plurality of threshold values according to print modes and ink colors is read from a ROM, and test ink discharge is performed with respect to corresponding color ink. The result of the discharge is compared with the threshold value. Thus, whether or not the printhead is in normally-dischargeable status is judged with respect to each color ink.

14 Claims, 15 Drawing Sheets

U.S. PATENT DOCUMENTS 5,508,722 A * 4/1996 Saito et al. ..... 347/17
5,508,826 A 4/1996 Lloyd et al. ..... 358/501
5,689,289 A 11/1997 Watanabe et al. ..... 347/7
5,963,225 A 10/1999 Sugiyama
6,012,795 A 1/2000 Saito
6,048,045 A 4/2000 Nohata

* cited by examiner

24
CONTROLLER
19
FLEXIBLE CABLE
5
PRINTHEAD
32
MOTOR DRIVER
31
M
CONVEYANCE MOTOR
33
MOTOR DRIVER
30
M
CARRIDGE MOTOR
53
MOTOR DRIVER
52
M
READING MOTOR
25
CPU
RAM
ROM
27
26
21
CARRIAGE HOME-POSITION SENSOR
28
A/D CONVERTER
8
PHOTOSENSOR
48
READING SENSOR
CLOCK
29
54
PRINTER INTERFACE
56
EXTERNAL COMPUTER
55
COMMUNICATION LINE CONTROLLER
57
TELEPHONE LINE
58
OPERATION PANEL
LCD
59

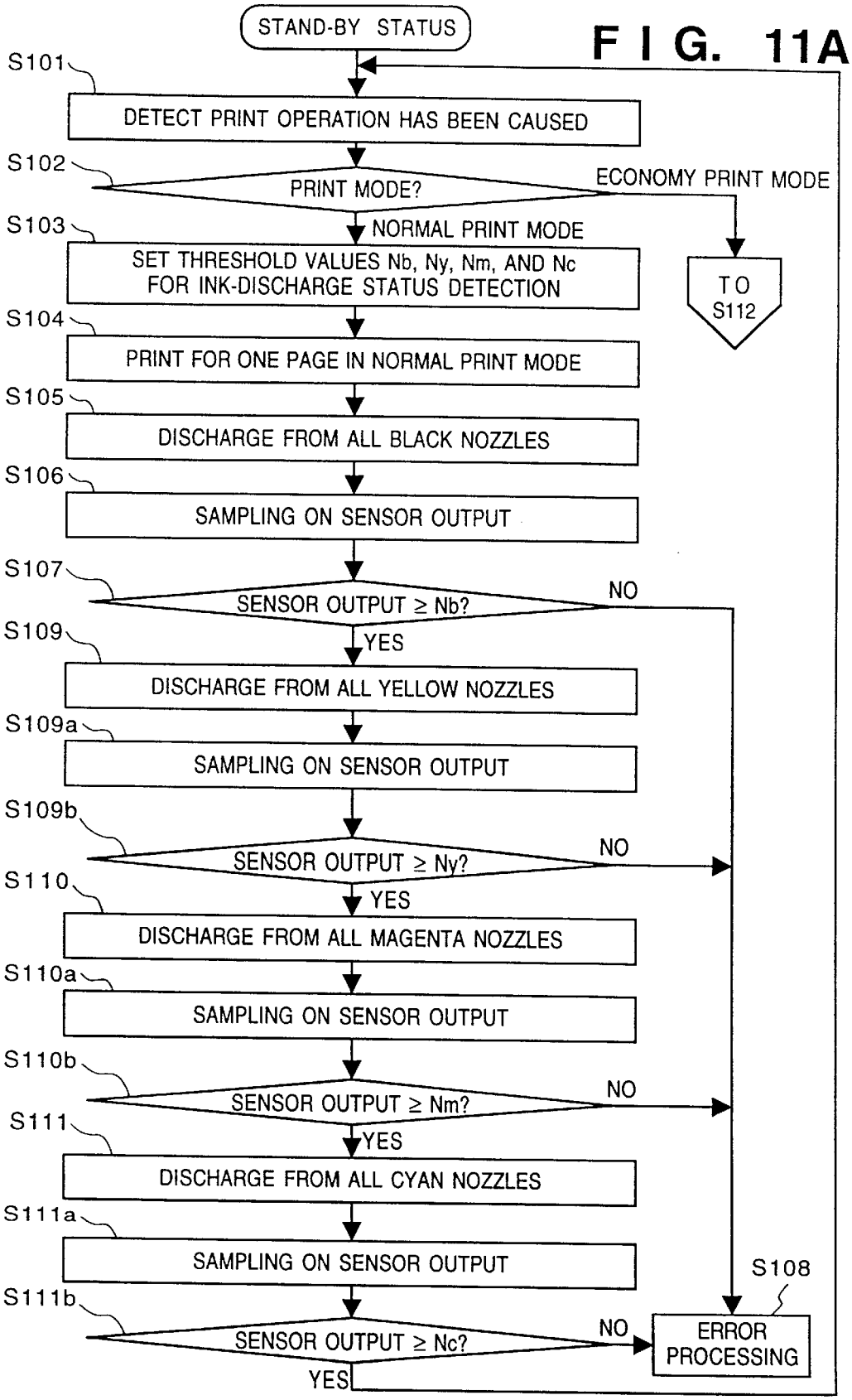
FIG. 11A
STAND-BY STATUS
S101
DETECT PRINT OPERATION HAS BEEN CAUSED
S102
PRINT MODE?
ECONOMY PRINT MODE
NORMAL PRINT MODE
TO S112
S103
SET THRESHOLD VALUES Nb, Ny, Nm, AND Nc FOR INK-DISCHARGE STATUS DETECTION
S104
PRINT FOR ONE PAGE IN NORMAL PRINT MODE
S105
DISCHARGE FROM ALL BLACK NOZZLES
S106
SAMPLING ON SENSOR OUTPUT
S107
SENSOR OUTPUT ≥ Nb?
NO
YES
S109
DISCHARGE FROM ALL YELLOW NOZZLES
S109a
SAMPLING ON SENSOR OUTPUT
S109b
SENSOR OUTPUT ≥ Ny?
NO
YES
S110
DISCHARGE FROM ALL MAGENTA NOZZLES
S110a
SAMPLING ON SENSOR OUTPUT
S110b
SENSOR OUTPUT ≥ Nm?
NO
YES
S111
DISCHARGE FROM ALL CYAN NOZZLES
S111a
SAMPLING ON SENSOR OUTPUT
S111b
SENSOR OUTPUT ≥ Nc?
NO
YES
S108
ERROR PROCESSING

METHOD AND APPARATUS FOR DETECTING THE DISCHARGE STATUS OF INKJET PRINTHEADS

This application is a division of application Ser. No. 08/724,480, filed Oct. 1, 1996, now U.S. Pat. No. 6,056,386.

BACKGROUND OF THE INVENTION

This invention relates to a printer and a facsimile apparatus using the printer and, more particularly to a printer which prints an image on a print medium in accordance with and ink-jet printing method and a facsimile apparatus using the printer.

An ink-jet printer which performs printing by discharging ink droplets from a printhead, comprising a plurality of nozzles, on a print medium such as a print sheet or an OHP sheet, in accordance with an ink-jet printing method, has advantages such as low running cost, suitability for color printing, and quiet print operation. Therefore, the ink-jet printer is widely used as a printing unit of facsimile apparatuses, copying machines and the like, as well as an output device of computers.

Further, as a printhead of this printer, a monochrome printhead which performs monochrome printing by using only one color ink, e.g., black ink, and a color printhead which supplies yellow, magenta, cyan and black color ink and performs color printing by discharging ink from nozzles assigned to the respective colors have been provided.

Upon applying the printer to a facsimile apparatus, for printing based on received facsimile image information, a mechanism to detect print-disable status such as ink exhaustion and ink-discharge failure is provided. That is, in the conventional technique, to avoid omission of image printing due to ink exhaustion during image printing using received facsimile image data, existence/absence of ink is judged after printing of one page. If it is judged that ink remains, data corresponding to printed image is deleted from an image memory. For this judgment, the printer has a photosensor (photo-interrupter) including a light-emission device comprising an LED or the like and a photoreception device comprising a photo-transistor or the like. As ink-discharge status detection, ink-discharge failure status due to ink exhaustion or status where nozzles are clogged with some foreign materials due to some reasons and printing is not normally performed, is detected by discharging ink so as to interrupt light from the light-emission device, and monitoring change of the light received by the photoreception device.

FIG. 15 is a cross-sectional view showing the structure of a printer included in a facsimile apparatus.

As shown in FIG. 15, a plurality of print sheets P are piled on a cassette 151, and taken out by a paper-feed roller 152, one by one, to a conveyance roller 153, and further, to a printer B. The printer B has a printhead 160 which performs printing in accordance with an ink-jet printing method and which is scanned in a direction (main-scanning direction) orthogonal to a print-sheet conveyance direction. The printhead 160 comprises a large number of nozzles (e.g. 128) in a direction orthogonal to the main-scanning direction (X direction in FIG. 15 is the subscanning direction). Image printing is made by discharging ink from the printhead 160 on the surface of the print sheet P while scanning the printhead 160 in the main-scanning direction. After the completion of image printing, the print sheet P is conveyed by a pair of discharge rollers 154 along a guide 155 in the X direction, and discharged by a discharge roller 156, a discharge rod 157, onto a discharge stacker 158, and stacked there.

The printhead 160 mounted to this apparatus is a cartridge type printhead which includes an ink tank. When ink is exhausted, the printhead can be exchanged for a new printhead with an ink tank. To attain color printing with downsizing of the apparatus main body, the printhead 160 has 64 nozzles to discharge black ink, and respectively 24 nozzles to discharge ink of primary three colors, yellow, cyan and magenta. The respective color ink can be replenished by independently changing small separate ink tanks of respective colors.

Upon applying the printer having this construction to a facsimile apparatus, to ensure print-output of received image information, it is necessary to detect print-disable status such as ink exhaustion and ink-discharge failure. As method for detection, a technique to directly discharge ink between a light-emission device and a photoreception device constituting a photo-interruptive type photosensor has been proposed. The change of output from the photosensor caused by interruption of light from the light-emission device by the discharged ink is detected and ink-discharge abnormality can be judged based on the result of detection.

In the photo-interruptive type photosensor, a lens is integrally molded on a light-emitting surface, so that the light-emission device can irradiate light in approximately parallel toward a photoreception device such as a photo-transistor. On the other hand, the photoreception device has a 0.7×0.7 mm hole formed of a mold member, on the optical axis, on its photoreception surface. That is, a detection area is narrowed to 0.7 mm in height and 0.7 mm in width between the photoreception device and the light-mission device. The optical axis connecting the light-emission device and the photoreception device is set to parallel to the nozzle array of the printhead. The interval between the light-emission device and the photoreception device is wider than the nozzle array of the printhead. When the optical axis and the position of the nozzle array coincide, all ink droplets discharged from the nozzles of the printhead pass the detection area between the light-emission device and the photoreception devices the ink droplets pass the detection area, the ink droplets interrupt light from the light-emission side, and decrease light intensity to the photoreception side, thus the output from the photo-transistor as the photoreception device changes. Since the number of nozzles to discharge ink is approximately proportional to the amount of change of the output from the photosensor, if the variation of the output from the photosensor is equal to a predetermined threshold value or greater, it is judged that in; remains, i.e., "print operation has been normally performed". In contrast, if the variation of the output from the photosensor is less than the threshold value, it is judged that ink-discharge is poor, i.e., "print operation has not been normally performed". In this case, further print operation is suspended until recovery operation such as ink-tank change is made, and facsimile reception is stopped or received data is stored into an image memory.

The ink-discharge status detection using the photo-interruptive type photosensor as described above is made such that after the completion of printing for one page of print sheet, ink is simultaneously discharged from all the nozzles necessary for facsimile reception printing, e.g., 64 black-ink nozzles.

Further, in case of judgment of existence/absence of ink with respect to color ink based on the amount of change of output from the photosensor, the judgment is made by using a threshold value common to the respective colors. For the judgment, to improve detection precision, the amount of ink to be discharged is changed in accordance with ink color.

However, when the color printhead is attached to a conventional facsimile apparatus for monochrome image printing, to print an image based on received image data on a print medium, black ink is discharged from only the nozzles assigned to black ink. Accordingly, in comparison with a printhead for monochrome printing (monochrome printhead), the number of black-ink nozzles is smaller. Even if all the nozzles assigned to black ink are used for discharging black ink, ink-discharge amount differs in the two type of printheads, and the degree of interruption of light from the light-emission device differs in the printheads. As a result, an output signal from a photo-transistor used for judgment of existence/absence of ink varies in accordance with the type of printhead attached to the apparatus.

Accordingly, the comparison of the output signal from the photo-transistor with one threshold value cannot attain exact judgment of existence/absence of ink.

Regarding the printer according to an ink-jet printing method, to further utilize the advantage of the printing method, it has a print mode (normal print mode) for discharging ink from all the nozzles of a printhead to form an image and another print mode (economy print mode) for discharging ink from alternate nozzles to form an image with only the half amount of ink used in normal print mode.

On the other hand, residual-ink detection and ink-discharge status detection in the conventional printer is made by discharging black ink necessary for printing based on received facsimile data from all the nozzles assigned to black ink. Even when facsimile-reception printing is performed in the economy print mode, judgment of ink-discharge status on nozzles which are not related to image formation is included in judgment of normal/abnormal printing status.

However, assuming that an average value of the amount of change of the output, obtained from the photoreception device, in case of normal ink discharge from 60% of the all nozzles, is employed as a threshold value for judgment of normal/abnormal print operation, if facsimile-reception printing is performed in the economy print mode, and 30% of all the nozzles are in poor ink-discharge status, further, if most of those poor nozzles are used in actual printing, a control circuit of the facsimile apparatus judges that printing has been normally performed and deletes image data stored in an image memory.

If print operation is performed in the normal print mode, a printed image includes faint portions at about 30%, which causes no problem for practical purpose of legibility; however, in the economy print mode, a printed image includes faint portions at about 60%, which disturbs interpretation of information provided by the printed image. In the latter case, as data is deleted from in the image memory, the information is entirely lost.

Further, in a case where the ink-jet printer is used as a terminal of a computer, if precision of ink-discharge status detection is low, there is a possibility that, in printing a document file of tens of pages in the economy print mode, a large number of images where information is not intelligible at all is outputted. In this case, print-output must be retried, which increases a user's labor, further, wastes resources such as print sheets and ink, as a result, raises the running cost.

In consideration of the tendency of development of current technologies, it is predicted that color facsimile apparatuses and color printers will greatly become popular in the future. Print control based on residual-ink detection must be directed to, as well as black ink, ink of three primary colors, yellow, cyan and magenta. However, detection precision of residual-ink detection for respective color ink differs in colors unless the following factors are fully considered: (1) a printhead may have a construction where the number of black-ink nozzles and those of nozzles assigned to other color ink are different; (2) light-transmittances of respective color ink are different; (3) variation of output from a photoreception device differs in respective color ink since diameter of nozzle and that of ink droplet are different in respective color so as to form appropriate color image by adjusting tints of respective colors.

For example, as in the conventional printer, if existence/absence of ink is judged by using a threshold value common to the respective color ink, as respective light-transmittances of the respective color ink with respect to the photo-interruptive type photosensor are not considered, the detection result has low reliability. Further, if ink-discharge amount is changed in accordance with ink color, the amount of ink used for ink-discharge status detection differs for each ink color. This causes a problem that particular color ink is consumed in ink-discharge status detection and exhausted earlier than other ink.

SUMMARY OF THE INVENTION

Accordingly, the present invention has its object to provide a printer which performs accurate residual-ink detection even if the type of printhead attached thereto is changed.

According to the present invention, the foregoing object is attained by providing a printer which uses one of plural types of exchangeable printheads, and which performs printing by discharging ink from the printhead on a print medium, comprising: an ink tank for containing ink; first discrimination means for discriminating a type of a printhead which is attached to the printer; selection means for selecting one of a plurality of threshold values set in consideration of printing characteristics corresponding to the plural types of printheads, in accordance with the result of discrimination by the first discrimination means; test-discharge means for discharging ink from the printhead as test discharge; detection means for detecting ink droplets discharged by the test discharge means; and second discrimination means for comparing the result of detection by the detection means with the threshold value selected by the selection means, and discriminating ink-discharge status, based on the result of comparison.

In accordance with this aspect of the present invention as described above, when one of plural types of exchangeable printheads is attached to a printer for performing printing by discharging ink on a print medium, the type of the attached printhead is discriminated, and one of plural threshold values, each obtained by considering the printing characteristic of corresponding printhead, is selected, in accordance with the result of discrimination. Then, ink is test-discharged from the printhead, and discharged ink droplets are detected. The result of detection is compared with the selected threshold value, and existence/absence of ink is judged in accordance with the result of comparison.

It may be arranged such that a message advising to change ink tank(s) is displayed in accordance with the result of judgment.

The detection of ink droplets upon test ink discharge is made by using light-emission means for emitting light to a position where the ink droplets discharged from ink-discharge orifices of the printhead pass, photoreception means for receiving the light from the light-emission means, and measurement means for measuring a period in which the light is interrupted between the light-emission means and the photoreception means.

The light-emission means includes an infrared LED, on the other hand, the photoreception means includes a phototransistor for generating an electric signal based on received light.

Note that the printhead may be an ink-jet printhead which performs printing by discharging ink or a printhead which utilized thermal energy to discharge ink and has electrothermal transducers for generating thermal energy to be supplied to ink.

It is another object of the present invention to provide a facsimile apparatus using the printer having the above construction.

According to another aspect of the present invention, the foregoing object is attained by providing a facsimile apparatus using the above printer, comprising: reception means for receiving image information transmitted via a communication line; memory means for storing image information received by the reception means; and control means for controlling the test-discharge means to perform test ink discharge after completion of each image printing, based on the image information received by the reception means, for one page of print medium.

In accordance with this aspect of the present invention as described above, in reception of facsimile image information by the facsimile apparatus using the printer having the above construction, each time image printing based on the received image information for one page of print medium has been completed, test ink discharge is made to perform ink-discharge status detection.

Then, in accordance with the result of ink-discharge status detection, the received image information stored in the memory means is held or deleted.

It is still another object of the present invention to provide a color printer which releases a user from tiresome operations and ensures printing with high reliability, and low running cost.

According to still another aspect of the present invention, the foregoing object is attained by providing a color printer using a color printhead which performs color printing on a print medium using a plurality of color ink, comprising: instruction means for selecting a first mode to perform printing by using all of a plurality of print elements of the color printhead or a second mode to perform printing by using a part of the plurality of print elements, and instructing the selected mode as a print mode; input means for inputting image data; print means for performing printing on the print medium, based on the image data inputted by the input means, by using the color printhead, in accordance with the print mode instructed by the instruction means; and detection means for, after completion of printing on the print medium, test-discharging all the plurality of color ink from the color printhead, and in consideration of the print mode instructed by the instruction means and ink characteristics of the respective plurality of color ink, based on results of discharge of the plurality of color ink, and detecting whether or not the color printhead is in normally-dischargeable status.

In accordance with this aspect of the present invention as described above, upon printing, the color printhead which performs printing by discharging a plurality of color ink on a print medium is used, and the first mode for printing by using all the print elements of the printhead or the second mode for printing by using a part of the print elements is selected and instructed as a print mode. In accordance with the selected mode, image printing based on input image data on a print medium is performed by using the color printhead. After the printing has been completed, all the plurality of color ink are test-discharged from the color printhead, and based on the result of test discharge, ink-discharge status detection of respective color ink is performed, in consideration of the instructed mode and characteristics of the respective color ink.

Then, in accordance with the result of detection, print operation is controlled, or if it judged that ink is exhausted, a message notifying of ink exhaustion is displayed on, e.g., a LCD.

The ink-discharge status detection is made by using test discharge means for test-discharging all the plurality of color ink from the color printhead, detection means for detecting test-discharged ink droplets, and first discrimination means for discriminating whether or not respective color ink still remain, based on the result of detection by the detection means. Further, upon test ink discharge, the detection of ink droplets is made by using light-mission means which emits light to a position where the ink droplets discharged from ink-discharge orifices of the printhead pass, photoreception means for receiving the light, and measurement means for measuring a time period in which the light is interrupted between the light-emission means and the photoreception means.

The variation of the amount of received light at the photoreception means is measured as analog data, and the measurement means may include an A/D converter for converting the analog data into digital data.

The light-emission means includes an infrared LED, on the other hand, the photoreception means includes a phototransistor for generating an electric signal based on received light.

Note that the printhead may be an ink-jet printhead which performs printing by discharging ink or a printhead which utilized thermal energy to discharge ink and has electrothermal transducers for generating thermal energy to be supplied to ink.

Further, the plurality of color ink includes black ink, yellow ink, magenta ink, and cyan ink.

Further, the plurality of printing elements of the color printhead include a first nozzle group for discharging black ink, a second nozzle group for discharging yellow ink, a third nozzle group for discharging magenta ink, and a fourth nozzle group for discharging cyan ink. When printing is performed in the first mode, all the nozzles of the first to fourths nozzle groups are used, while in the second mode, the half of the nozzles of the respective first to fourth nozzle groups are used.

It may also be arranged such that in the ink-discharge status detection as described above, the results of ink discharge of the respective color ink are compared by, e.g., using eight threshold values stored in the memory means respectively according to moded and color ink, and existence/absence of respective color ink is judged from the result of comparison.

Note that the means for comparing the discharge results comprises a comparator having a first terminal for inputting a signal indicating the detection results and a second terminal for inputting threshold values for comparison. The threshold values are at least different in accordance with ink color.

Further, the above-described ink-discharge status detection may be performed by using test print means for printing a predetermined pattern at a predetermined position of a print medium, irradiation means for irradiating light to the predetermined pattern, a second photoreception means for receiving reflection light of the light irradiated by the irradiation means, and second discrimination means for discriminating whether ink remains or not, in accordance with the amount of received light amount.

It is still another object of the present invention to provide a facsimile apparatus using the color printer having the above construction.

According to still another aspect of the present invention, the foregoing object is attained by providing a facsimile apparatus using the above color printer, comprising: communication means for transmitting and receiving facsimile image data via a communication line; memory means for storing facsimile image data received by the communication means; and memory control means for controlling deletion of the facsimile image data stored in the memory means.

In accordance with this aspect of the present invention as described above, in the facsimile apparatus using the color printer having the above construction, facsimile image data received via the communication line is stored into the memory means, and the received facsimile image data stored in the memory means is deleted otherwise held in accordance with the result of detection by the detection means.

The invention is particularly advantageous since accurate judgment of existence/absence of ink is possible even though the type of attached printhead is changed.

Further, according to another aspect of the present invention as described above, upon facsimile reception of image information, as ink-discharge status detection is performed by test ink discharge after the completion of each image printing based on the received image information for one page of print medium, whether an image has been normally printed or not can be confirmed for each page. This enables to confirm printing result for each page.

Further, according to still another aspect of the present invention as described above, more accurate ink-discharge status detection is possible in correspondence with print mode and respective ink characteristics.

This prevents printing of an image in degraded image quality due to exhaustion of ink, thus reduces running cost by eliminating unnecessary output. Also this prevents re-output, thus releases a user of the apparatus from tiresome operations.

Furthermore, upon printing facsimile reception image, printing of an image in degraded image quality and undesirable deletion of received image data from an image memory can be prevented. This contributes to facsimile communication with high reliability.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and together with the description, serve to explain the principles of the invention.

FIGS. 11A and 11B are flowcharts showing residual-ink detection according to the second embodiment;

DETAILED DESCRIPTION OF THE PREFERRED EMBODIMENTS

Preferred embodiments of the present invention now be described in detail in accordance with the accompanying drawings.

Figure 1:
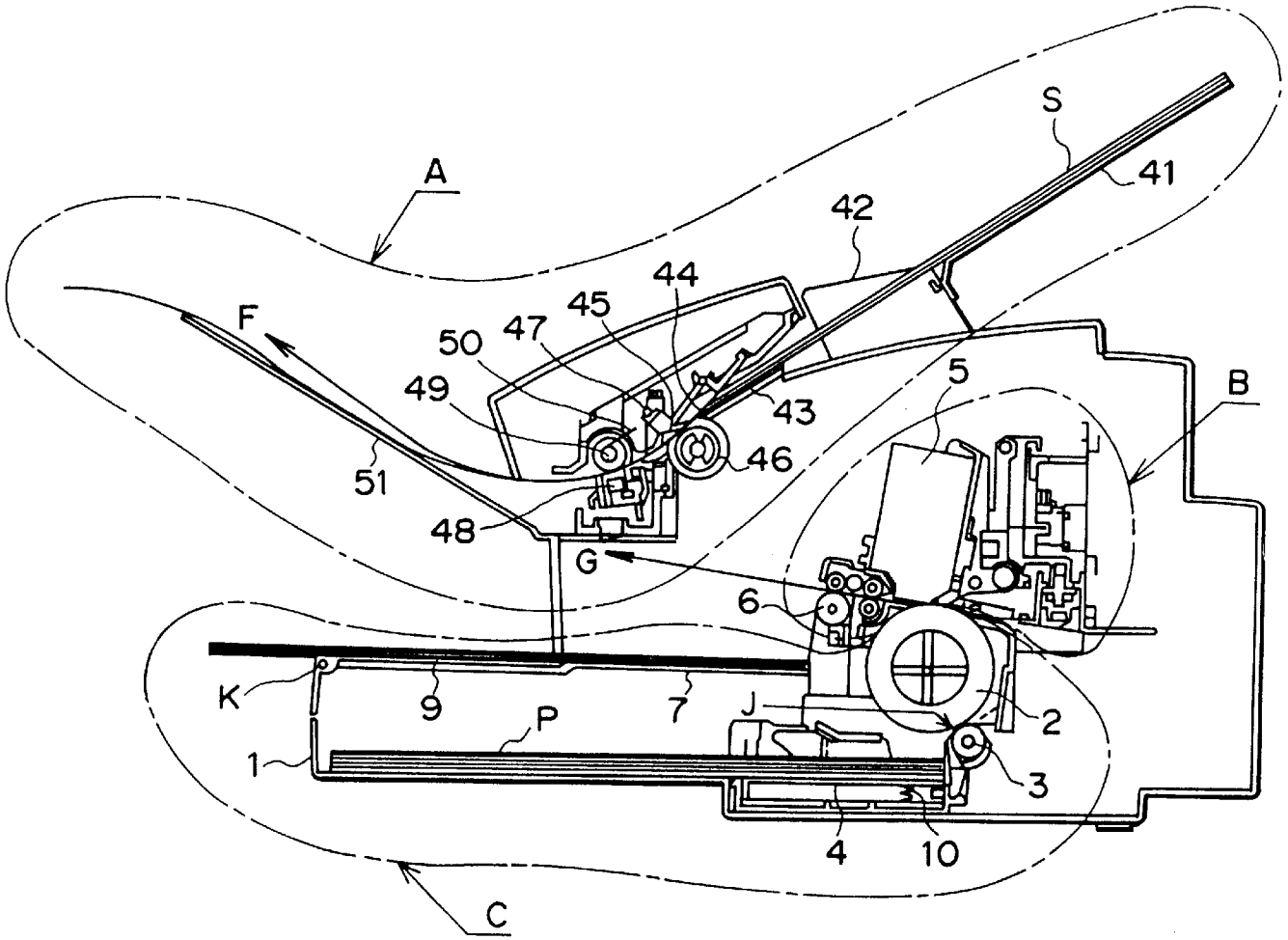
FIG. 1 is a cross-sectional view showing a structure of a facsimile apparatus comprising a printer, which performs printing by a printhead in accordance with an ink-jet printing method, according to a representative embodiment of the present invention.

FIG. 1 is a cross-sectional view showing a structure of a facsimile apparatus comprising a printer, which performs printing by a printhead in accordance with an ink-jet printing method, according to a representative embodiment of the present invention.

The printer has a cartridge type monochrome printhead for monochrome printing or a cartridge type color printhead for color printing. Both printheads are exchangeable. Further, both printheads integrally include an exchangeable ink tank.

Hereinbelow, the general structure of the facsimile apparatus will be described with reference to FIG. 1. In FIG. 1, reference A denotes a reader which optically reads an original; B, a printer which performs printing in accordance with an ink-jet printing method; and C, a paper feeder which supplies print medium such as a print sheet P, set in a paper cassette, one sheet at a time, to the print sheet B.

First, the flow of operation in the printer P will be described. A conveyance path of the print-sheet sheet P is as shown by an arrow G. That is, the print sheet C set in the paper cassette 1 of the paper feeder C is picked up by a paper-feed roller 2 and a retard roller 3, and supplied to the printer B by the paper-feed roller 2. The printer B performs printing by discharging ink from a printhead 5 on the print sheet P, while conveys the print sheet P in synchronization with the printing. When the printing is completed, the print sheet P is discharged by a discharge roller 6 onto a discharge stacker 7.

Next, the specific construction of the paper feeder C will be described.

In FIG. 1, the paper cassette 1 for containing a plural number of print sheets P has a middle plate 4 on which the print sheets P are placed. The middle plate 4 is biased upward from its back by a middle-plate spring 10 provided opposite to the paper-feed roller 2. In paper-feed stand-by status, the middle plate 4 has a structure which is pressed downward by a cam or the like and when the number of print sheet P has decreased or there is no print sheet P, additional print sheets can be easily set.

On the other hand, when a print signal is detected and paper-feed operation is started, the middle plate 4 pressed downward by the cam and the like is released, and the print sheet P is picked up by the paper-feed roller 2. The retard roller 3 is positioned opposite to the paper-feed roller 2, and is cooperated with the middle plate 4 to change the position of the print sheet P. Upon paper-feed operation, only the uppermost print sheet P, biased by the middle plate 4 and picked up by the paper-feed roller 2, is separately conveyed by cooperation at a unit J with the paper-feed roller 2. The separated print sheet P is supplied, while being held so as to sufficiently wind around the paper-feed roller 2, to the printer B.

Next, a discharge mechanism for the paper sheet P printed by the printer B will be described.

The print sheet P discharged by the discharge roller 6 is discharged onto the discharge stacker 7. The discharge stacker 7 has an auxiliary discharge tray 9 which rotates on a hinge K. In a case where the print sheet P is used from the shorter side as the top, the auxiliary discharge tray 9 is rotated so as to extend the stacker area of the discharge stacker 7 in the paper-discharge direction. The discharge stacker 7 also serves as a cover of the paper cassette 1. Note that the discharge stacker 7 and the auxiliary discharge tray 9 respectively have a plurality of ribs (not shown). The printed print sheet P is slided on the plurality of ribs, and sequentially accumulated.

Further, the flow of conveyance of an original S will be described.

A conveyance path for the originals is as shown by an arrow F in FIG. 1. In FIG. 1, the original S is placed, with the image-side surface being faced down, on an original tray 41. The original S placed on the original tray 41 is positioned by a slider 42 which is movable in an original-widthwise direction. As the original S is placed on the original tray 41, the original S is pressed by a pre-conveyance pressing piece 43 from an upper position via a pre-conveyance spring 44, and the original S is preliminarily conveyed in cooperation with a separation roller 46.

Then, preliminarily-conveyed originals S are separately conveyed from the bottom sheet in cooperation with a separation piece 45 and the separation roller 46, pressed downward by an ADF spring 47, one by one. Further, the separation roller 46 conveys the separated original S to a reading position. Thus, the image on the original S separately-conveyed by the separation roller 46 to the reading position is read by a reading sensor(photoelectric transducer) 48. A CS roller 49 is biased downward by a CS pressing spring 50 along a reading line of the reading sensor 48, to press the separately-conveyed original S against the reading line. Further, the CS roller 49 determines a reading speed for reading the original S in a sub-scanning direction (original-conveyance direction), and discharges the read original S. Finally, the discharged original S is stacked on the discharge tray 51. Note that the discharge tray 51 is detachable from the apparatus main body.

Figure 2:
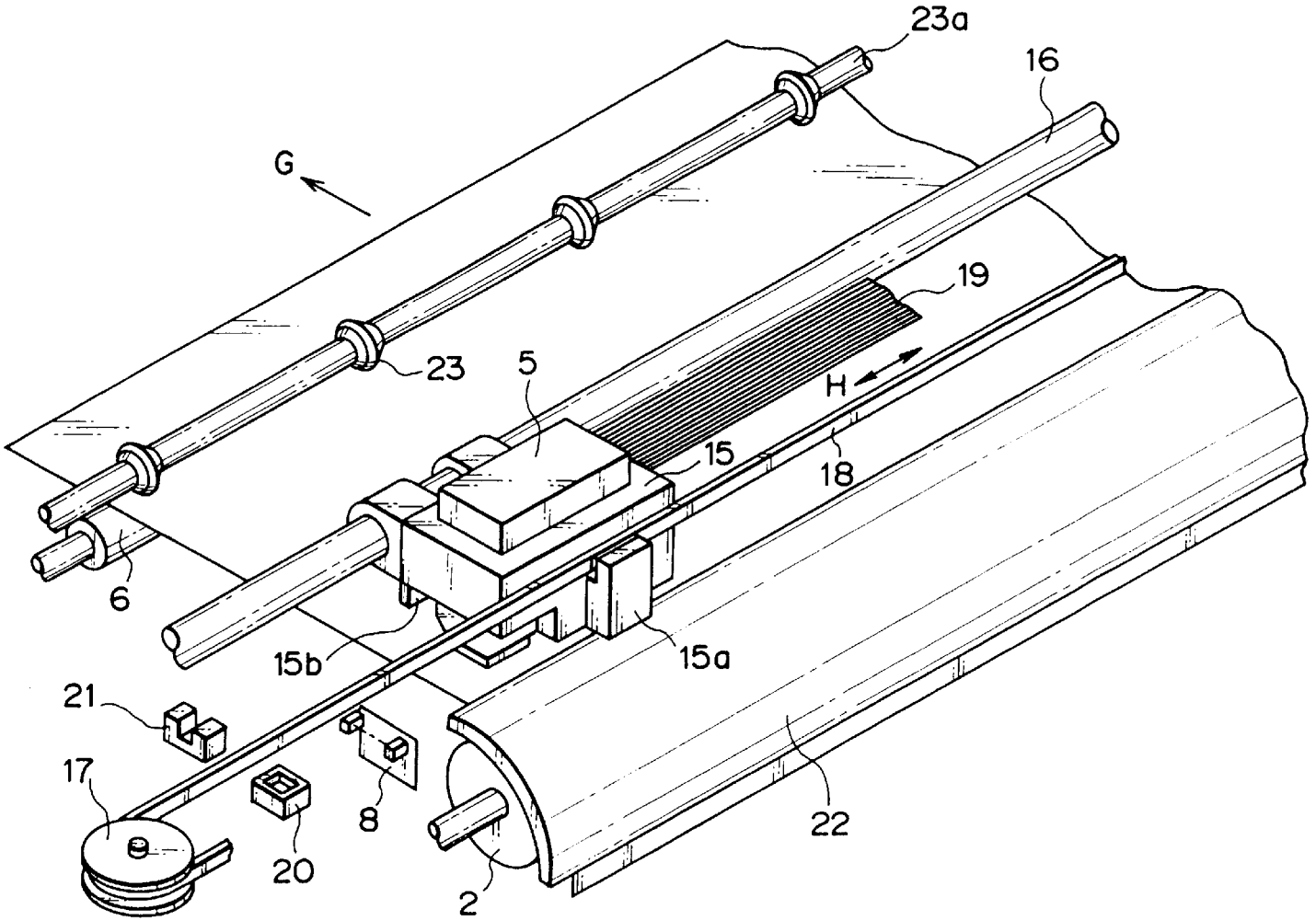
FIG. 2 is a perspective view showing a detailed structure of a printer B of the facsimile apparatus in FIG. 1.

FIG. 2 is a perspective view showing the detailed structure of the printer B. The printhead 5 in FIG. 2 is a cartridge type printhead including an exchangeable ink tank for a new ink tank when ink is exhausted. Further, the printhead 5 is a cartridge type printhead comprising a monochrome printhead or a cartridge type printhead comprising a color printhead, and any of the cartridges can be changed according to printing purpose.

Figure 3A:
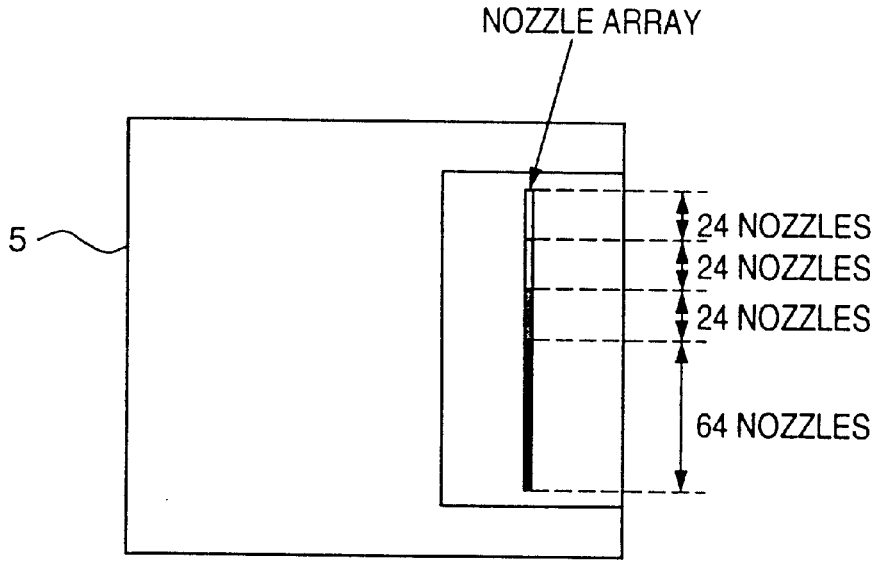
FIGS. 3A and 3B are explanatory views showing nozzle arrangement of a color printhead and a monochrome printhead.
Figure 3B:
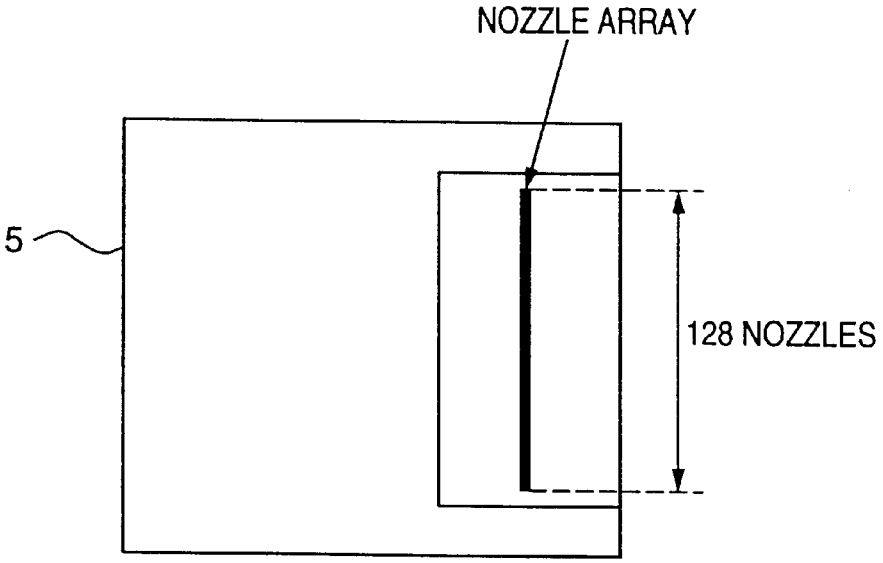

FIGS. 3A and 3B are explanatory views showing a structure of a color printhead and that of a monochrome printhead, used in the facsimile apparatus in FIG. 1. The facsimile apparatus uses the monochrome printhead as shown in FIG. 3B, having an array of 128 nozzles, for printing using only black ink in 360 dpi resolution, or the color printhead as shown in FIG. 3A, having 64 black-ink nozzles, 24 yellow-ink nozzles, 24 magenta-ink nozzles, and 24 cyan-ink nozzles, for printing in 360 dpi resolution. In this color printhead, the nozzles are also arranged in an array. Since ink colors are pre-determined with respect to respective 24-nozzle groups, the color of ink to be discharged can be selected by selecting nozzles to receive heat pulses. By selecting from the two types of printheads, high-speed monochrome printing or high-precision full-color printing can be performed. When the color printhead is attached, if a facsimile image has been received, the 64 black-ink nozzles are used for printing based on the received image.

Next, a principle of ink discharge will be described below. It is common to the monochrome printhead and the color printhead. Further, the color printhead has two separate ink tanks, for black ink and color ink, both can be changed independently.

Generally, the printhead comprises fine liquid discharge orifices, fluid channels and energy acting portions each provided at a part of each fluid channel, and energy-generating portions which generate liquid-droplet formation energy to be acted on liquid at the energy-generating portions.

The energy-generating portion may employ a electromechanical transducer such as a piezoelectric device; otherwise, the energy-generating portion may irradiates an electromagnetic wave such as a laser beam upon a liquid so that electromagnetic energy is absorbed in the liquid, the liquid is heated up, and liquid droplets are discharged by action due to generated heat; otherwise, the energy-generating portion may employ an electrothermal transducer to heat a liquid and discharge the liquid. Above all, a printhead using an ink-discharge method utilizing thermal energy can perform high-resolution printing, since the liquid-discharge orifices for discharging liquid droplets for printing can be arranged in high density.

A printhead using the electrothermal transducers as the energy-generating portions can be easily downsized. This printhead can fully utilize advantages of IC-manufacturing techniques and microprocess techniques, which have been greatly improved and are highly reliable in recent semiconductor-manufacturing. Further, the number of print nozzles in this printhead can be increased in one direction so as to extend the printing width or print nozzles in this printhead can be assembled to form a two-dimentional (two rows) nozzles array. For these reasons, this printhead is suitable for multi-nozzle manufacturing and high-density assembling. Further, this printhead can be directed to mass production with low production costs.

Thus, the printhead, using electrothermal transducers as the energy-generating portions, manufactured via semiconductor-manufacturing processes, generally has ink channels corresponding to respective ink-discharge orifices and electrothermal transducers as means for forming discharge ink droplets. The electrothermal transducers impart thermal energy to ink filling the ink channels, and discharge the ink from corresponding ink-discharge orifices. The ink channels are connected to a common liquid chamber, and they are supplied with the ink from the common liquid chamber.

Note that regarding manufacture of an ink-discharge portion, Japanese Patent Application Laid-Open No. 62-253457 discloses a method comprising: sequentially accumulating a solid-material layer to form at least liquid channels on a first substrate, a layer of activation-energy beam setting material to form at least partition walls of the liquid channels, and a second substrate; overlaying a mask on the second substrate; irradiating an activation-energy beam from above the mask, so that at least the partition walls of the liquid channels are set as constituting members; eliminating-unset portions of the solid-material layer and the layer of activation-energy beam setting material between the two substrates, thus forming at least liquid channels.

The construction of the printer B will be described with reference to FIG. 2.

In FIG. 2, a carriage 15 scans the printhead 5 in a direction (main-scanning direction; represented by an arrow H) orthogonal to the print-sheet P conveyance direction (subscanning direction; represented by arrow G direction in FIG. 1), while holding the printhead 5 with high precision. The carriage 15 is slidably held by a guide shaft 16 and a thrust member 15*a*. The scanning movement of the carriage 15 is performed by a pulley 17 driven by a carriage motor 30 (not shown in FIG. 2) and a timing belt 18. At this time, a print signal and electric power are supplied via a flexible cable 19 to the printhead 5 from an electric circuit of the apparatus main body. The printhead 5 and the flexible cable 19 are connected by press-connecting respective contact points with each other. By detecting the connections between specific contact points of the printhead 5, the CPU 25 recognizes which of the cartridge for monochrome printing and the cartridge for color printing is attached.

A cap 20 which functions as an ink receptor is provided at the home position of the carriage 15 of the printer B. The cap 20 moves up/down in accordance with necessity. When the cap 20 moves up, it comes into tight contact with the printhead 5 to cover the nozzle portion of the printhead 5, thus preventing evapration of ink and attachment of extraneous matter (dust) to the nozzles.

In this apparatus, to arrange the printhead 5 and the cap 20 to positions relatively opposite to each other, a carriage home-position sensor 21 provided in the apparatus main body and a light-shield plate 15*b* provided at the carriage 15 are employed.

The carriage home-position sensor 21 uses a photo-interrupter. When the carriage 15 moves to a standby position, light irradiated from a part of the carriage home-position sensor 21 is interrupted by the light-shield plate 15*b*; at this time, it is detected that the printhead 5 and the cap 20 are at relatively opposite positions.

In FIG. 2, the print sheet P is fed from the lower side to the upper side in this drawing paper, and bent in a horizontal direction by the paper-feed roller 2 and the paper guide 22, then conveyed in the arrow G direction (subscanning direction). The paper-feed roller 2 and the discharge roller 6 are respectively driven by a drive motor (not shown); they operate, interlocked with scanning of the carriage 15, to convey the print sheet P in the subscanning direction with high precision. Further, rollers 23 comprising of water repellent material and having blade-like circumferential portions to contact the print sheet P are provided for paper feeding in the subscanning direction. The rollers 23 are arranged on a roller shaft 23*a* opposite to the discharge roller 6, at a predetermined intervals. Even when the rollers 23 come into contact with unfixed image on the print sheet P immediately after printing, the rollers 23 guide and convey the print sheet P without influencing the image.

Figure 4:
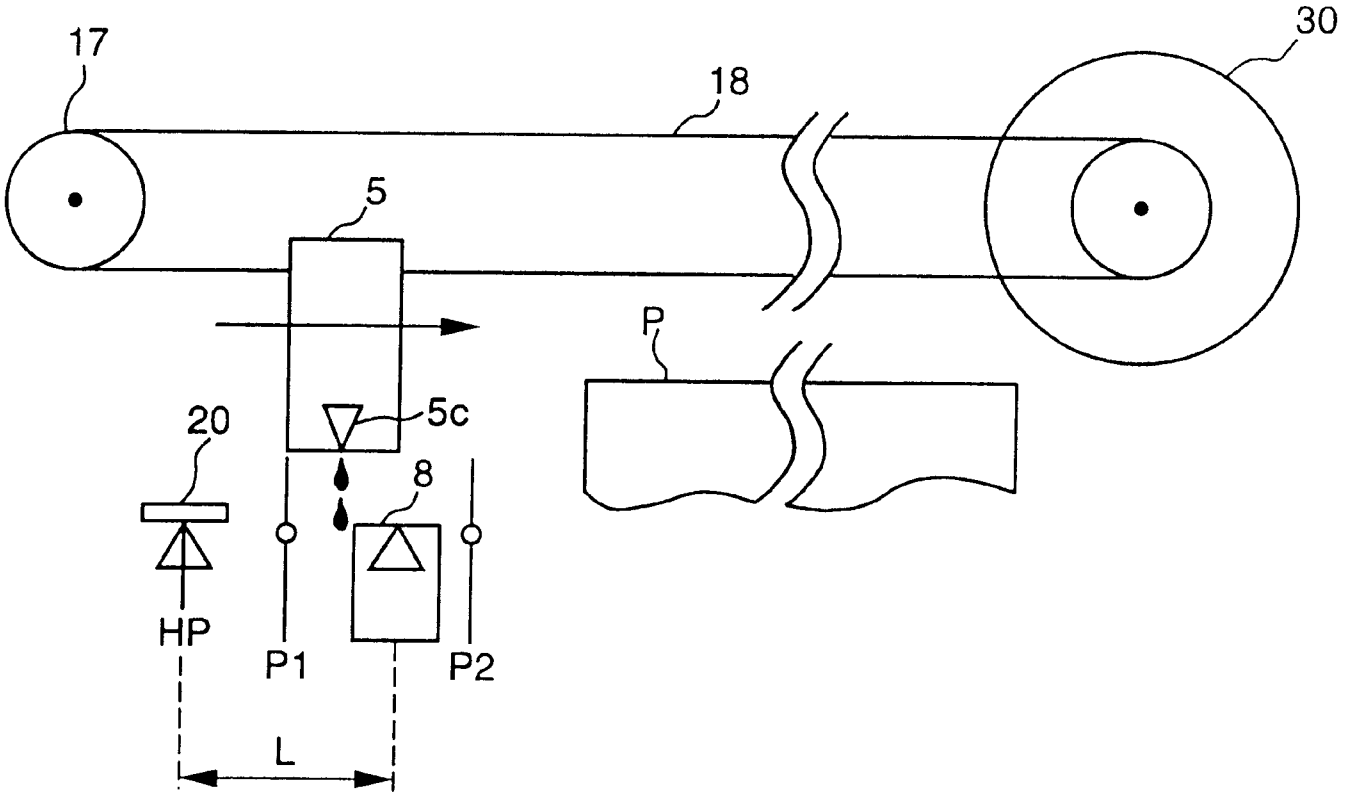
FIG. 4 is a schematic view showing a construction around a photosensor 8 of the printer B.

FIG. 4 is a schematic view showing a construction around a photosensor 8 of the printer B. As shown in FIG. 4, the photosensor 8 is provided between the cap 20 and the end of the print sheet P, at a position opposite to a nozzle array 5*c* of the printhead 5. The photosensor 8 optically detects ink droplets discharged by the nozzles of the printhead 5. When there is no ink in the printhead 5, the ink-exhausted status can be judged from output from the photosensor 8.

In the present embodiment, the photosensor 8 employs an infrared LED as a light-emission device, and a lens is integrally molded on the light-emission surface of the LED, so as to irradiate light in approximately parallel toward a photoreception device. The photoreception device is a photo-transistor having a 0.7×0.7 mm hole formed of a mold member, on the optical axis, on its photoreception surface. That is, a detection range is narrowed to 0.7 mm in height and 0.7 mm in width between the photoreception device and the light-emission device. The optical axis connecting the light-emission device and the photoreception device is set to parallel to the nozzle array 5*c* of the printhead 5. The interval between the light-mission device and the photoreception device is greater than the length of the nozzle array 5*c* of the printhead 5. When the optical axis and the position of the nozzle array 5*c* coincide, all ink droplets discharged from the nozzles of the printhead 5 pass the detection range between the light-emission device and the photoreception device. As the ink droplets pass the detection range, the ink droplets interrupt light from the light-emission side, and decrease light intensity to the photoreception side, thus the output from the photo-transistor as the photoreception device changes.

Similar to positioning of the printhead 5 and the cap 20, the carriage home-position sensor 21 provided in the apparatus main body is used to arrange the nozzle array 5*c* of the printhead 5 and the photosensor 8 at relatively opposite positions.

Figure 5:
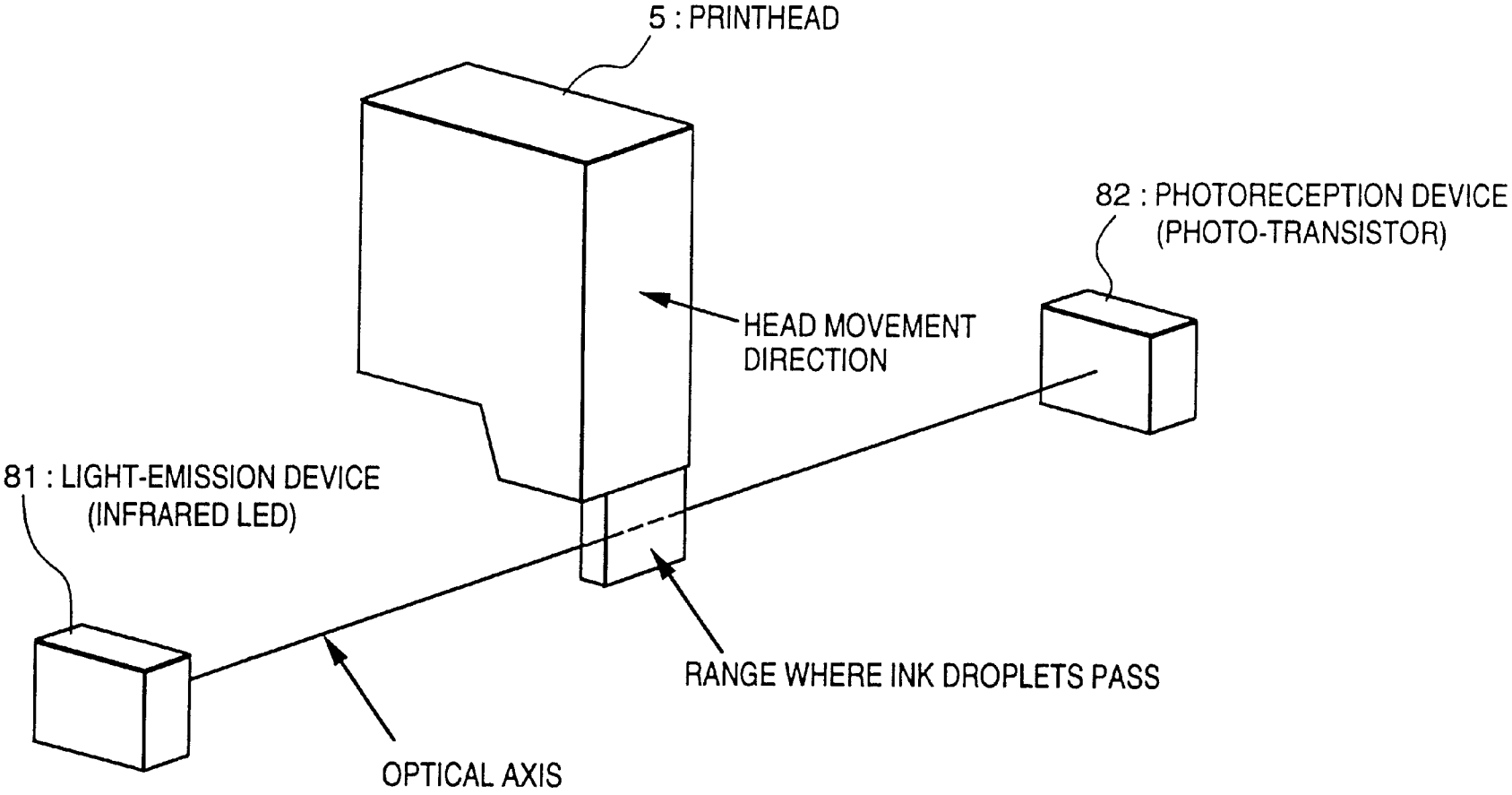
FIG. 5 is an explanatory view showing arrangement where ink discharged from the printhead interrupts a light beam from an infrared LED 81 as a light-emission device of a photosensor 8.

As shown in FIG. 4, this embodiment converts a distance (L), between the home position (HP) of the printhead 5 and a position on the optical axis of the photosensor 8, into a number of steps of a motor for driving the carriage 15, and sets in advance this number of steps of the motor as a constant in a control program to execute print operation. Thus, by moving the carriage 15 by a predetermined amount after detection of the home position, the nozzle array 5*c* of the printhead 5 and the optical axis of the photosensor 8 are precisely set at relatively opposite positions. As shown in FIG. 5, ink-discharge status detection is performed by moving the printhead 5 to a position P1 to a position P2, about severel mm, before printing for one page or after the completion of printing, and discharging ink so as to interrupt a light beam from the infrared LED 81 (FIG. 5). This enables more reliable ink-discharge status detection by discharging ink while slightly moving the printhead 5 in consideration of shift of attachment position of the photosensor 8 with respect to the printer main body. If the discharged ink interrupts the light beam traveling to a photo-transistor 82, which is the photoreception device of the photosensor 8, and variation of output from the photo-transistor 82 is equal to a predetermined threshold or greater, it is judged that ink discharge is normally performed.

Figure 6:
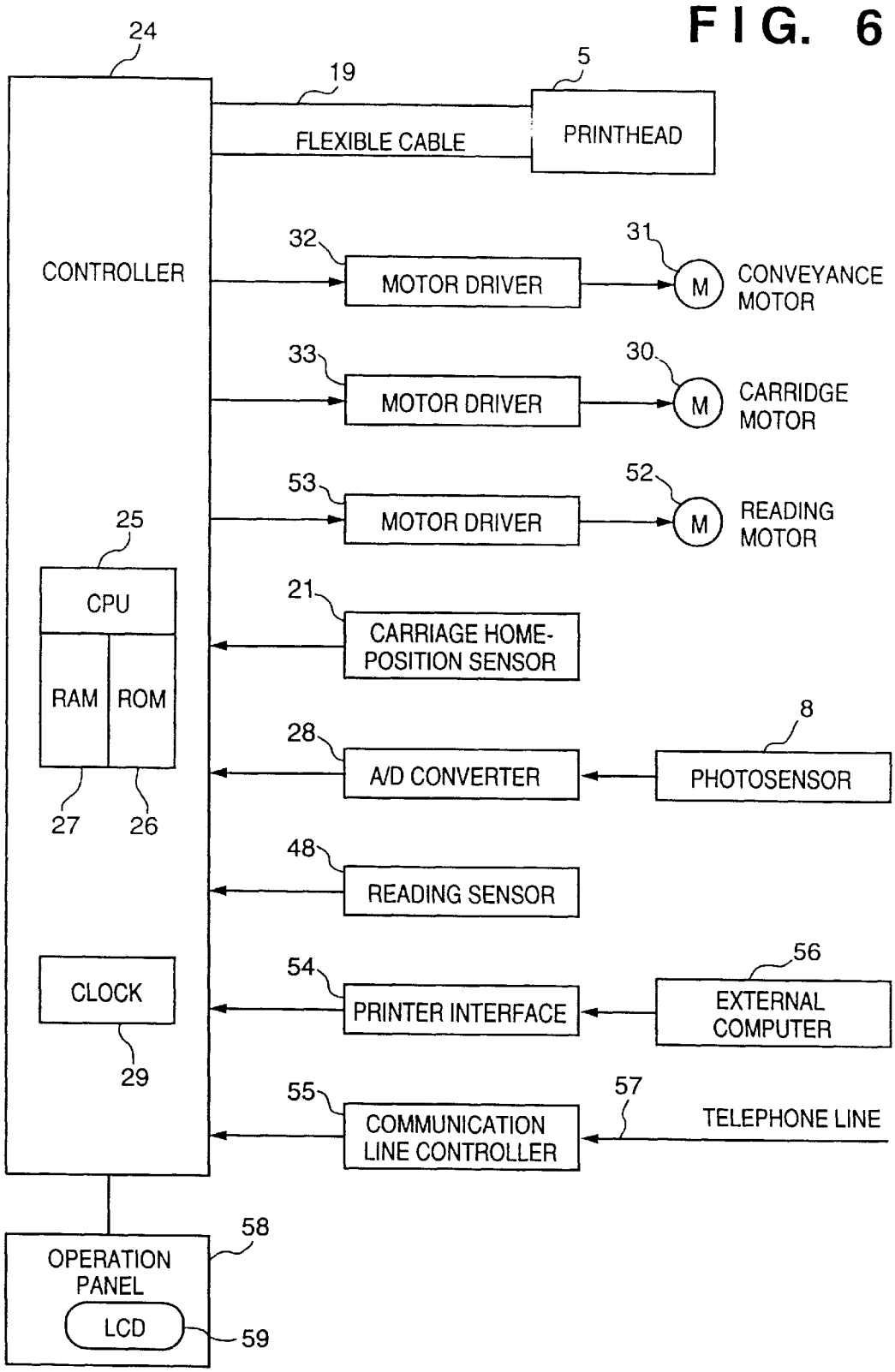
FIG. 6 is a block diagram showing a control construction of the facsimile apparatus in FIG. 1.

FIG. 6 is a block diagram showing a control construction of the facsimile apparatus in FIG. 1.

In FIG. 6, numeral 24 denotes a controller for controlling the overall apparatus. The controller 24 comprises a CPU 25, a ROM 26 in which control programs to be executed by the CPU 25 and various data, several threshold values used in ink-discharge status detection to be described later are stored, a RAM 27 used as a work area for execution of various processing by the CPU 25 and used for temporarily storing various data.

As shown in FIG. 6, the printhead 5 is connected to the controller 24 via the flexible cable 19. The flexible cable 19 includes a control-signal line from the controller 24 to the printhead 5, an image signal line, and a signal line to output a signal for discriminating whether the printhead 5 is a monochrome printhead or a color printhead. The output from the photosensor 8 is digitized by an A/D converter 28 so that it can be analyzed by the CPU 25. The carriage motor 30 is rotatable based on a pulse-step number from a motor driver 32. Further, the controller 24 controls the carriage motor 30 via a motor driver 33, a conveyance motor 31 via a motor driver 32, and a reading motor 52 via a motor driver 53. Also, it inputs output from the carriage home-position sensor 21.

The controller 24 is connected to image-data input devices such as the reading sensor 48, a printer interface 54 for receiving print instruction from an external computer 56 and print data, and a communication line controller 55 for receiving reception data from a telephone line 57. Thus, the controller 24 can be used with a printer for facsimile transmission/reception, a copier, and a printer of the external computer. Further, the controller 24 is connected to an operation panel 58 for a user of the apparatus to perform various operations and instructions. The operation panel 58 has an LCD 59 for displaying messages.

Next, embodiments of the present invention having the above construction as a common construction will be described.

First Embodiment

Figure 7:
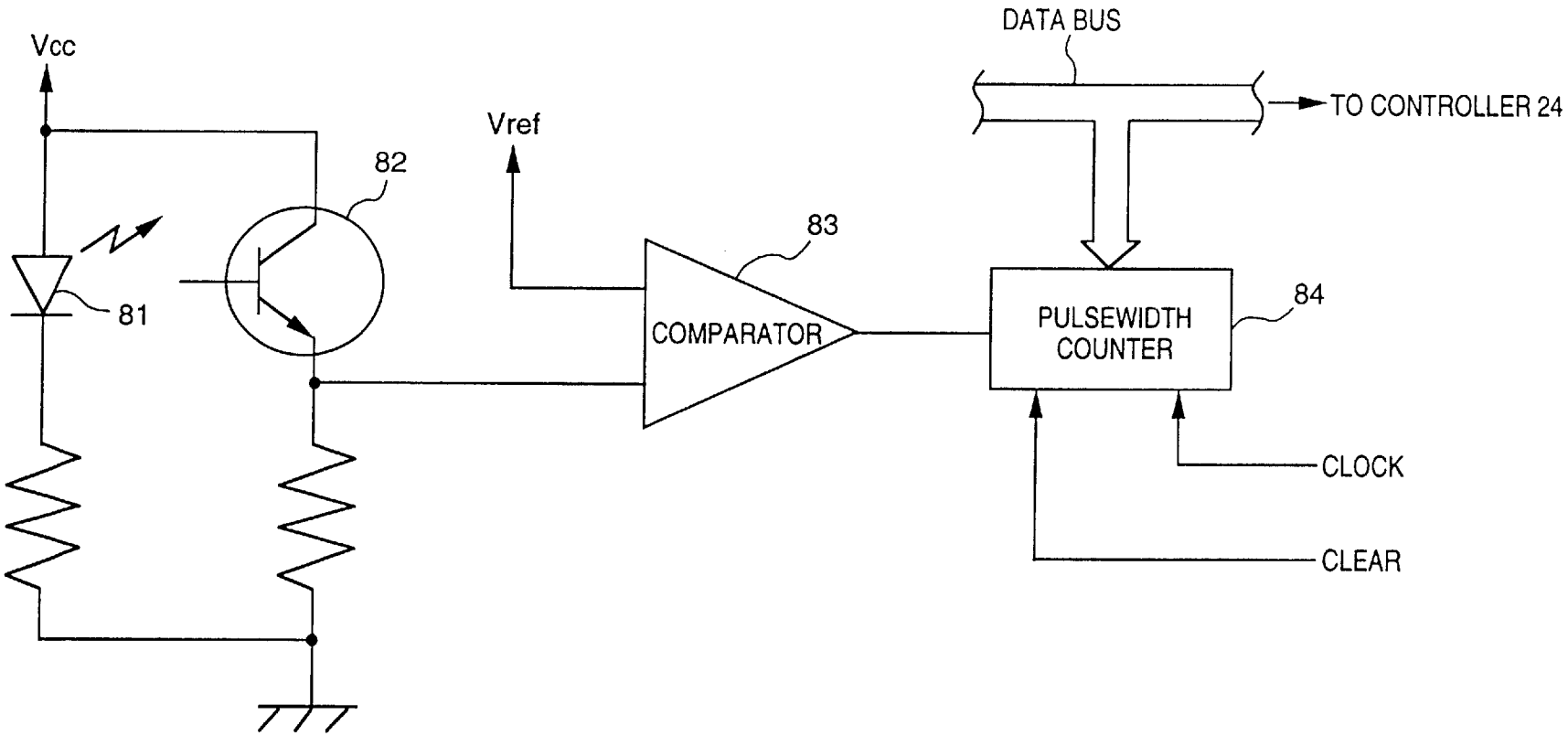
FIG. 7 is a block diagram showing an electrical construction of the photosensor 8 according to a first embodiment.

FIG. 7 is a block diagram showing an electrical construction of the photosensor 8, according to a first embodiment. As it is apparent from this figure, there are several circuits between the photo-transistor 82 and the controller 24. Output from the photo-transistor 82 is processed by these circuits, and outputted to the controller 24.

In FIG. 7, numeral 81 denotes the infrared LED as the light-emission device; 82, the photo-transistor as the photoreception device to receive an infrared light beam from the infrared LED 81; 83, a comparator which inputs output from the photo-transistor 82 and compares it with a predetermined reference voltage (Vref); and 84, a pulsewidth counter which measures a duration (pulsewidth) of ON/OFF status of a signal outputted from the comparator 83. The pulsewidth counter 84 uses a pulsewidth of an inputted clock (reference clock) as a reference pulsewidth. The pulsewidth counter 84 counts cycles of the reference clock for the duration of ON/OFF status of the signal outputted from the comparator 83, and outputs a count value to an internal register of the pulsewidth counter 84.

If ink is not discharged from the printhead 5, the infrared light beam from the infrared LED 81 as the light-emission device is not interrupted, the comparator 83 inputs a high (H) level signal from the photo-transistor 82 as the photoreception device. On the other hand, if ink is discharged from the printhead 5, the discharged ink interrupts the infrared light beam from the infrared LED 81, the output level of the signal from the photo-transistor 82 is gradually lowered. When the output level becomes lower than the reference voltage (Vref) inputted into the comparator 83, the output from the comparator 83 to the pulsewidth counter 84 is inverted. Thereafter, when the ink discharge from the printhead 5 has been completed, the output level of the signal from the photo-transistor 8 becomes high (H) again, and when the output level exceeds the reference voltage (Vref) inputted into the comparator 83, the output from the comparator 83 is inverted again.

Thus, the pulsewidth counter 84 inputs a signal corresponding to a duration in which the photosensor 8 detects discharged ink. As described above, the duration of the signal ON/OFF status is measured by using the reference clock, and the count value is stored into the internal register of the pulsewidth counter 84. The count value is read out by the CPU 25 of the controller 24 after the completion of ink discharge, and used for judgment of existence/absence of ink.

It is understood from the nozzle arrangement as shown in FIGS. 3A and 3B, the number of black-ink nozzles (64) of the color printhead is the half of the nozzles (128) of the monochrome printhead. Generally, upon driving a printhead, to reduce electric power consumed at once and avoid overheating the printhead itself, time-divisional drive control is employed. That is, assuming that the number of nozzles to discharge ink at once is eight, for example, in a printhead having 64 nozzles, printhead drive is made eigth times; in a printhead having 128 nozzles, printhead drive is made sixteen times. Accordingly, when the color printhead is used for printing with only black ink, in comparison with black-ink discharge from the monochrome printhead, time necessary for ink discharge is half. In this case, the pulsewidth determined by the pulsewidth counter 84 is also short (approximately half).

Figure 8:
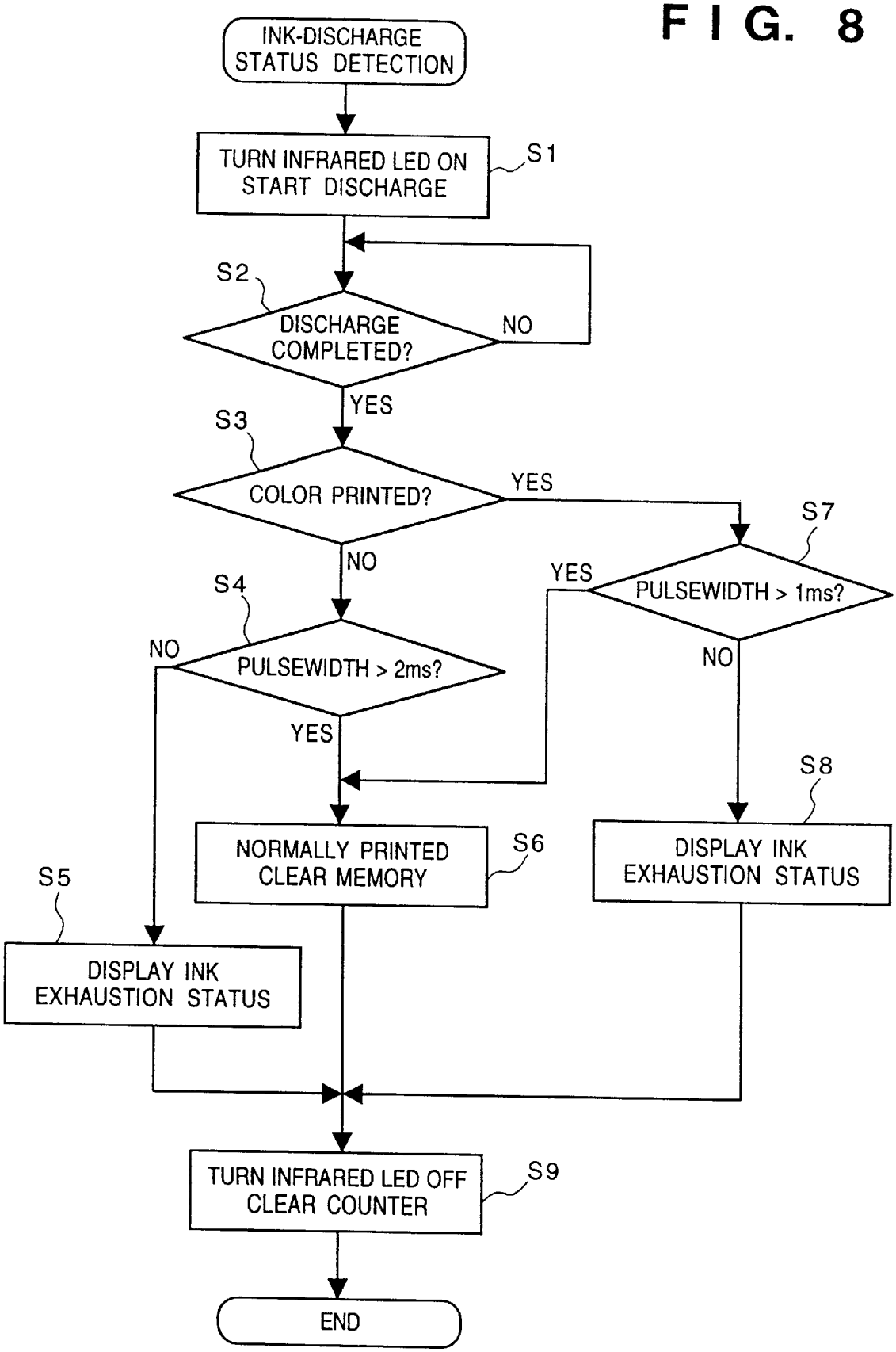
FIG. 8 is a flowchart showing ink-discharge status detection according to the first embodiment.

Next, ink-discharge status detection in the facsimile apparatus having the above construction will be described with reference to the flowcharts of FIGS. 8. Note that the facsimile apparatus receives facsimile image data via the telephone line 57, prints based on the received data, and executes the following processing each time printing of one page of print sheet has been completed.

At step S1, the printhead 5 is moved to a position opposite to the photosensor 8, the infrared LED 81 as the light-emission device is turned on, and black ink is discharged from the printhead 5 while moving the printhead 5 several mm as described above. At step S2, when it is determined that the ink discharge has been completed, the processing proceeds to step S3, at which it is examined whether the currently-attached printhead is a color printhead or a monochrome printhead. If it is a monochrome printhead, the processing proceeds to step S4, while if it is a color printhead, proceeds to step S7.

At step S4, a pulsewidth (PW) counted by the pulsewidth counter 84 is compared with a threshold value. Considering that the printhead 5 is the monochrome printhead as shown in FIG. 3A and the pulsewidth obtained by the pulsewidth counter 84 is expected to be long, the threshold value used in this comparison is "2 ms". If PW≦2 ms holds, it is judged that ink is exhausted or nozzles are clogged, the processing proceeds to step S5, at which a message indicating ink exhaustion or abnormality of nozzles is displayed on the LCD 59, advising a user of the apparatus to change the ink cartridge or to check the printhead. Further, as the current printing is made based on the received facsimile image data, it may be arranged such that a message advising the user to attach a monochrome printhead is displayed. Then, it is judged that the print operation of the current page has not been normally performed, and the corresponding image data is held in an image memory. Thereafter, the processing proceeds to step S9. On the other hand, if PW>2 ms holds, it is judged that ink remains, and the processing proceeds to step S6, at which the corresponding received image data is deleted from the image memory. Thereafter, the processing proceeds to step S9.

At step S7, the pulsewidth (PW) counted by the pulsewidth counter 84 is compared with another threshold value. Considering that the printhead is the color printhead as shown in FIG. 3B and the pulsewidth obtained by the pulsewidth counter 84 is expected to be short, the threshold value used in this comparison is "1 ms". If PW≦1 ms holds, it is judged that ink is exhausted or nozzles are clogged, and the processing proceeds to step S8, at which a message indicating ink exhaustion or abnormality of nozzles is displayed on the LCD 59, advising the user to change the ink cartridge or to examine the printhead. Then it is judged that the printing of the current page has not been normally performed, and the corresponding image data is held in the image memory. Thereafter, the processing proceeds to step S9. On the other hand, if PW>1 ms holds, it is judged that ink remains, and the processing proceeds to step S6, at which the corresponding received image data is deleted from the image memory. Thereafter, the processing proceeds to step S9.

Finally, at step S9, the infrared LED 81 as the light-emission device is turned off, and the internal counter of the pulsewidth counter 84 is cleared, thus processing ends.

According to the above-described embodiment, the threshold value used in ink-discharge status detection is changed based on the type of attached printhead, and compared with the pulsewidth (PW) counted by the pulsewidth counter 84. This enables more accurate ink-discharge status detection in consideration of ink-discharge characteristics of the different types of printheads.

Note that in the present embodiment, the judgment reference (threshold value) of ink-discharge status detection is changed in consideration of ink-discharge characteristic derived from the number of nozzles of the printhead used in the printing, however, the present invention is not limited to this arrangement. For example, if print control to change a discharge frequency based on the type of discharge ink is possible, the judgment reference can be changed in accordance with the discharge frequency. In this case, the lower the discharge frequency becomes, the smaller an ink-discharge amount per unit period becomes. As a result, the period in which the output from the photo-transistor 82 is degraded is shorter, and the pulsewidth of output from the photo-transistor 84 is shorter. Accordingly, when the discharge frequency is low, the threshold value to be compared with the pulsewidth is set to be short.

Further, when the output from the photo-transistor 82 differs depending on the type (color) of discharged ink, the threshold to be compared with the pulsewidth may be changed in accordance with the type of ink to be discharged. In this case, the threshold value to be compared with the pulsewidth that is short corresponding to ink type (color) is set to be short.

Second Embodiment

First, the printhead used in a second embodiment will be described.

The printhead 5 according to this embodiment includes a cartridge of an ink-tank. When ink is exhausted, the cartridge is exchanged for a new cartridge.

Figure 9:
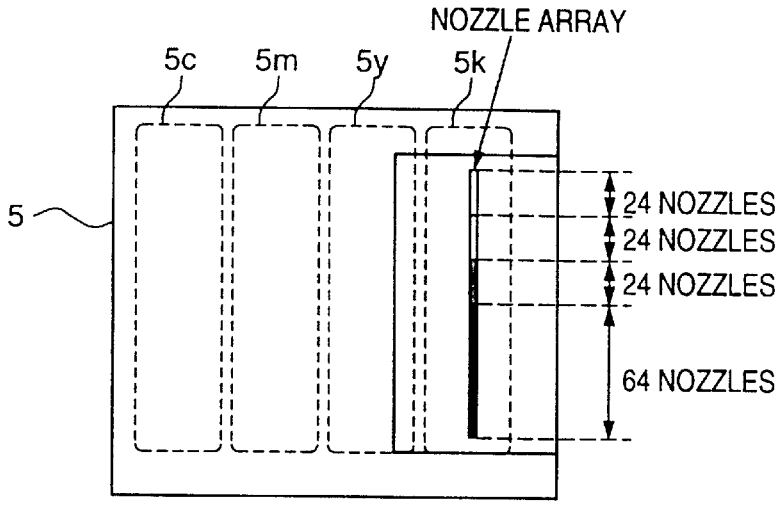
FIG. 9 is an explanatory view showing nozzle arrangement of a printhead 5 used in the facsimile apparatus in FIG. 1, according to a second embodiment of the present invention.

FIG. 9 shows nozzle arrangement of the printhead 5 used in the facsimile apparatus in FIG. 1, and ink tanks included in the printhead 5. The printhead 5 is a color printhead capable of printing in maximum 360 dpi. As shown in FIG. 9, the printhead 5 has 64 nozzles for discharging black ink, 24 nozzles for discharging yellow ink, 24 nozzles for discharging cyan ink, and 24 nozzles for discharging magenta ink. These nozzle groups are arranged in an array. Each nozzle discharges ink from a discharge orifice at the end, by film-boiling pressure caused in ink by heat generated by an electrothermal transducer provided in the nozzle. The cartridge has four ink tanks 5*c*, 5*m*, 5*y* and 5*k* for containing the respective color ink. When some color ink is exhausted, the ink tank can be exchanged for a new ink tank filled with the color ink.

The number of nozzles to discharge ink and change of output from the photo-transistor 82 as the photosensor are in approximately proportional relation, with variation of about ±10%. Further, as light-transmittance differs in ink colors, the difference in changes of output due to respective colored is in the following relation, under the condition that the respective ink-discharge status detection operations use the same number of nozzles:

black>magenta>cyan>yellow

Note that detailed values can be experimentally obtained.

That is, to accurately perform ink-discharge status detection to be described later, change of output from the photo-transistor 82 when black ink has been discharged from all the 64 nozzles, and output change when yellow ink has been discharged from all the 24 nozzles, output change when magenta ink has been discharged from all the 24 nozzles, and output change when cyan ink has been discharged from all the 24 nozzles, are experimentally obtained; then, change of output from the photo-transistor 82 when black ink has been discharged from the half of the 64 nozzles, i.e., 32 nozzles, and similarly, output change when yellow ink has been discharged from half of the 24 nozzles, i.e., 12 nozzles, output change when magenta ink has been discharged from half (12) of the 24 nozzles, and output change when cyan ink has been discharged from half (12) of the 24 nozzles, are experimentally obtained. In consideration of a certain margin and variation (the above 10% variation and 5% margin) of the obtained output changes, a pair of threshold values are determined for each color (i.e., total eight threshold values) as Nb, Ny, Nm, Nc, Eb, Ey, Em and Ec. These threshold values are stored into the ROM of the controller to be described later, and selectively used in accordance with print mode to be described later.

Note that in the eight threshold values, reference N represents threshold values for normal print mode; E, economy print mode; b, black ink; y, yellow ink; m, magenta ink; and c, cyan ink.

With these threshold values, when some color ink is not normally discharged from 5 to 25% of the nozzles assigned to the color ink, ink exhaustion can be detected. This prevents degradation of printing quality which even disturbs recognition of printed image.

Note that the use of the A/D converter in this embodiment makes a fast sampling of the output from the photo-transistor 82 possible.

Figure 10:
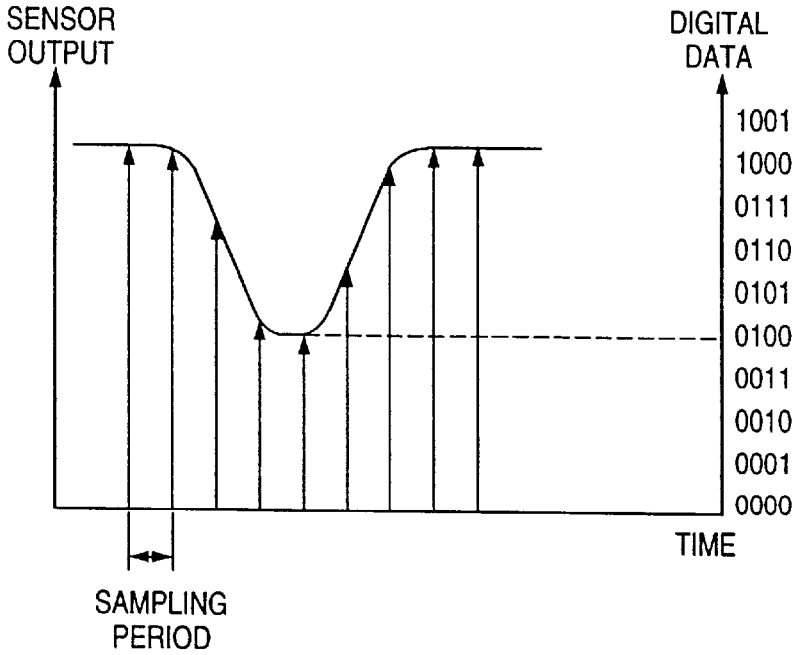
FIG. 10 is a graph showing the relation between input data and output data to/from an A/D converter 28.

FIG. 10 shows the relation between input data and output data to/from the A/D converter 28. In the present embodiment, analog output from the photo-transistor 82 of the photosensor 8 is inputted into the A/D converter 28 and processed there. The A/D converter 28 of this embodiment performs sampling (at fixed periods) on the input analog signal (output from the photosensor 8) to convert the signal into 4-bit digital data (0–15) and outputs the digital data. The controller 24 compares the digital data with a predetermined threshold value to judge existence/absence of ink. In the example of FIG. 10, a minimum value of the output digital data is "0100" by 4-bit representation. If the output value is less than the predetermined threshold value, it is judged that ink remains, while if the value is equal to or greater than the threshold value, it is judged that ink is exhausted. As described above, the threshold value is set for each ink color and print mode. It may be arranged such that upon changing an ink tank, ink is test-discharged so as to interrupt a light beam from the infrared LED 81, as ink-discharge status detection, and based on output data from the A/D converter 28, a predetermined multiple of the output value is employed as the threshold value.

The facsimile apparatus having the above construction has normal print mode to use all the nozzles of the printhead 5 and form a 360 dpi×360 dpi image, and economy print mode to perform thinning on every other line of image data in a subscanning direction and to use the half of the nozzles to form a 360 dpi (main-scanning direction)×180 dpi (subscanning direction) image. Comparing an image formed in the economy print mode with an image formed in the normal print mode, image quality of the image formed in the economy print mode is degraded, however, ink consumption related to image formation can be reduced to half. Accordingly, the economy print mode can be used in test printing where image quality is not so seriously considered or a case where mere conveyance of information is needed via facsimile communication. The print mode can be set by the user from the operation panel 58.

Figure 11B:
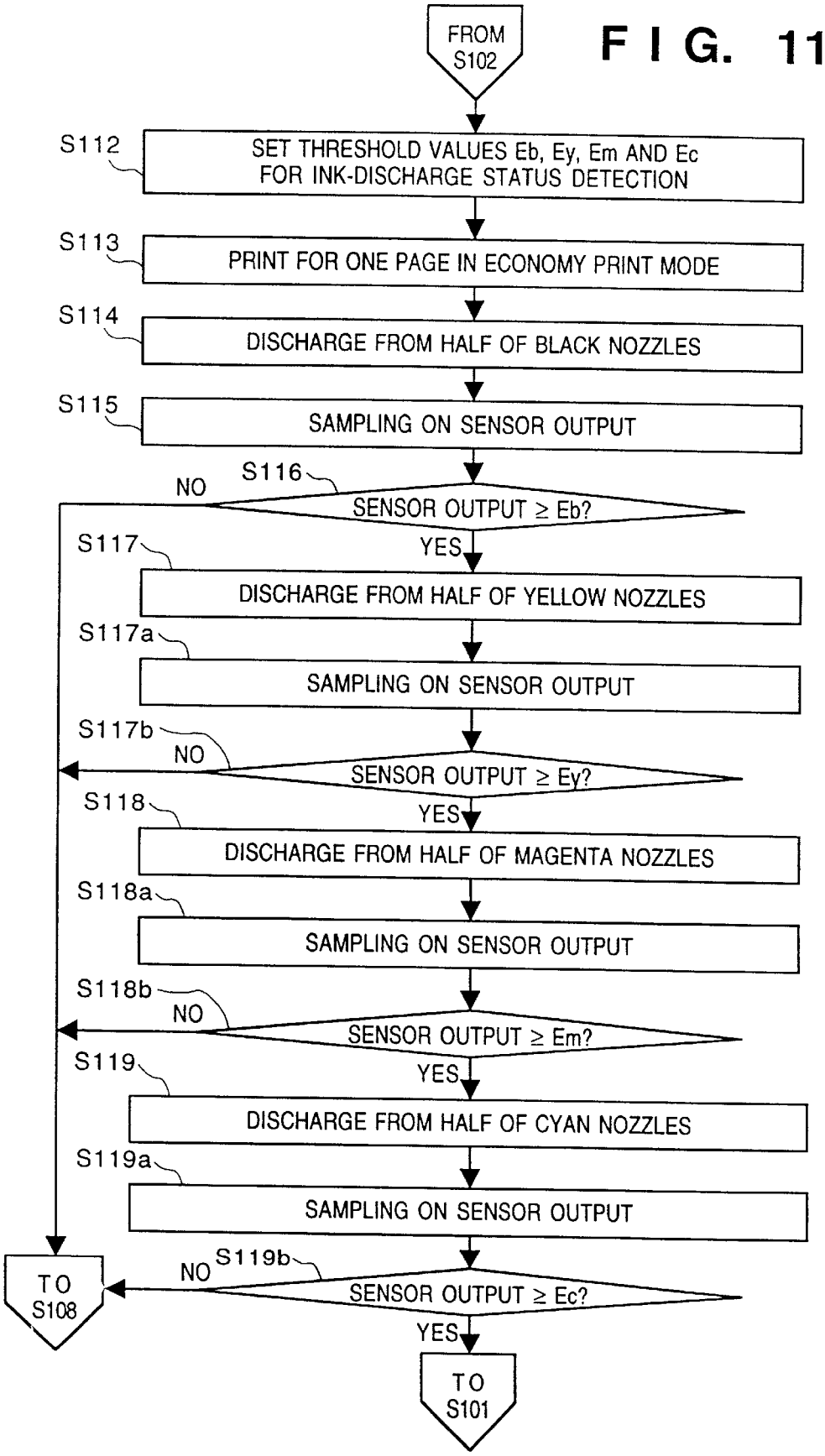

Next, ink-discharge status detection by using the facsimile apparatus having the above construction will be described with reference to the flowcharts of FIGS. 11A and 11B In this example, the apparatus is in stand-by status in which it can perform print operation.

When operation of the printer has been caused by copying operation, facsimile reception printing, or print instruction from an external device such as a computer, at step S101, the processing proceeds to step S102, at which it is examined whether the print mode is the normal print mode or the economy print mode. If it is determined that the print mode is the normal print mode, the processing proceeds to step S103, while if the print mode is the economy print mode, proceeds to step S112.

Next, at step S103, as the threshold values of ink-discharge status detection, the threshold values Nb (for black ink), Ny (for yellow ink), Nm (for magenta ink), and Nc (for cyan ink) for the normal print mode are read from the ROM 26, and set at predetermined addresses of a work area of the RAM 27. At step S104, one of the print sheets P is picked up and fed, and an image is printed on the print sheet P. At step S105, after the completion of printing, the carriage 15 is moved, and the home position of the carriage 15 is detected by the carriage home-position sensor 21. The carriage 15 is moved from the home position at a predetermined speed (about 300 mm/sec). As shown in FIG. 4, black ink is continuously discharged from all the 64 nozzles assigned to black ink, at frequency of 6 kHz, while the carriage 15 is moved from the position P1, about 2 mm in front of a detection position of the photosensor 8, through the detection position, to the position P2, about 2 mm beyond. The number of ink discharge is determined by the speed of movement of the carriage 15 and discharge range. In this example, ink discharge is made 80 times from each nozzle.

During this continuous ink discharge, the output from the photosensor 8 is sample-inputted via the A/D converter 28 at step S106. At step S107, it is examined whether or not the change of photosensor output (ΔD) exceeds the threshold value Nb, based on the sampled data. The processing from swep S105 to step S107 is ink-discharge status detection with respect to black ink in the normal print mode. If ΔD<Nb holds, it is judged that the black ink is exhausted, and the processing proceeds to step S108, at which error processing is performed. This error processing is, in facsimile transmission, for example, to store image data into the image memory defined as the RAM 27, display an error message on the LCD 59, and terminates print operation. Thereafter, when the user has exchanged the ink tank for new one, the image data is read from the image memory, and image printing is performed.

On the other hand, if ΔD≧Nb holds, the processing proceeds to step S109, at which yellow ink is continuously discharged from all the 24 nozzles, at the same carriage-movement speed, in the same discharge range, and at the same discharge frequency as that at step S105. At steps S109*a* and 109*b*, similar to steps S106 and 107, the output from the photosensor 8 is sample-inputted, and it is examined whether or not the change of photosensor output (ΔD) exceeds the threshold value Ny. If AD<Ny holds, it is judged that the yellow ink is exhausted, and the processing proceeds to step S108 to perform the error processing.

On the other hand, if AD≧Ny holds, the processing proceeds to step S110, at which magenta ink is continuously discharged from all the 24 nozzles, at the same carriage-movement speed, in the same discharge range, and at the same discharge frequency as that at step S105. At steps S110*a* and 110*b*, similar to steps S106 and 107, the output from the photosensor 8 is sample-inputted, and it is examined whether or not the change of photosensor output (ΔD) exceeds the threshold value Nm. If ΔD<Nm holds, it is judged that the magenta ink is exhausted, and the processing proceeds to step S108 to perform the error processing.

On the other hand, if ΔD≧Nm holds, the processing proceeds to step S111, at which cyan ink is continuously discharged from all the 24 nozzles, at the same carriage-movement speed, in the same discharge range, and at the same discharge frequency as that at step S105. At steps S111*a* and 111*b*, similar to steps S106 and 107, the output from the photosensor 8 is sample-inputted, and it is examined whether or not the change of photosensor output (ΔD) exceeds the threshold value Nc. If ΔD<Nc holds, it is judged that the cyan ink is exhausted, and the processing proceeds to step S108 to perform the error processing.

On the other hand, if ΔD≧Nc holds, it is judged that the respective color ink are normally discharged and all the color ink remain, and the processing returns to step S101.

Next, if it is determined that the print mode is the economy print mode, the processing proceeds to step S112, at which as the threshold values for ink-discharge status detection, threshold values Eb (for black ink), Ey (for yellow ink), Em (for magenta ink) and Ec (for cyan ink) are read from the ROM 26 and set at predetermined addresses of the work area of the RAM 27. At step S113, one of the print sheets P is picked up and fed, and an image is printed on the print sheet P. At step S114, similar to step S105, after the completion of printing, the carriage 15 is moved, and the home position of the carriage 15 is detected by the carriage home-position sensor 21. The carriage 15 is moved from the home position at a predetermined speed (about 300 mm/sec). As shown in FIG. 4, black ink is continuously discharged from the 32 nozzles assigned to black ink in the economy mode, at frequency of 6 kHz, while the carriage 15 is moved from the position P1, about 2 mm in front of a detection position of the photosensor 8, through the detection position, to the position P2, about 2 mm beyond. The number of ink discharge is determined by the speed of movement of the carriage 15 and discharge range. In this example, ink discharge is made 80 times from each nozzle.

During this continuous ink discharge, the output from the photosensor 8 is sample-inputted via the A/D converter 28 at step S115. At step S116, it is examined whether or not the change of photosensor output (ΔD) exceeds the threshold value Eb, based on the sampled data. The processing from step S114 to step S116 is ink-discharge status detection with respect to black ink in the economy print mode. Note that if ΔD<Eb holds, it is judged that the black ink is exhausted, and the processing proceeds to step S108, at which the error processing is performed.

On the other hand, if ΔD≧Eb holds, the processing proceeds to step S117, at which yellow ink is continuously discharged from the 12 nozzles assigned to yellow ink in the economy mode, at the same carriage-movement speed, in the same discharge range, and at the same discharge frequency as that at step S114. At steps S117*a* and 117*b*, similar to steps S115 and 116, the output from the photosensor 8 is sample-inputted, and it is examined whether or not the change of photosensor output (ΔD) exceeds the threshold value Ey. If ΔD<Ey holds, it is judged that the yellow ink is exhausted, and the processing proceeds to step S108 to perform the error processing.

On the other hand, if ΔD≧Ey holds, the processing proceeds to step S118, at which magenta ink is continuously discharged from the 12 nozzles assigned to magenta ink in the economy mode, at the same carriage-movement speed, in the same discharge range, and at the same discharge frequency as that at step S114. At steps S118*a* and 118*b*, similar to steps S115 and S116, the output from the photosensor 8 is sample-inputted, and it is examined whether or not the change of photosensor output (ΔD) exceeds the threshold value Em. If ΔD<Em holds, it is judged that the magenta ink is exhausted, and the processing proceeds to step S108 to perform the error processing.

On the other hand, if ΔD≧Em holds, the processing proceeds to step S119, at which cyan ink is continuously discharged from the 12 nozzles assigned to cyan ink in the economy mode, at the same carriage-movement speed, in the same discharge range, and at the same discharge frequency as that at step S114. At steps S119*a* and 119*b*, similar to steps S115 and S116, the output from the photosensor 8 is sampling-inputted, and it is examined whether or not the change of photosensor output (ΔD) exceeds the threshold value Ec. If ΔD<Ec holds, it is judged that the cyan ink is exhausted, and the processing proceeds to step S108 to perform the error processing.

On the other hand, if ΔD≧Ec holds, it is judged that the respective color ink are normally discharged and all the color ink remain, and the processing returns to step S101 again.

According to the present embodiment, more accurate ink-discharge status detection can be made by comparing the change of output from the photosensor 8 with eight threshold values in accordance with set print mode and respective color ink. This prevents, in any print mode, degradation of printing quality due to ink exhaustion and eliminates extra-labor of reprinting, further prevents wasteful consumption of ink and print sheets, thus contributes to reduction of running costs.

Since the control for deleting facsimile image data store in an image memory is performed, based on more accurate ink-discharge status detection, it prevents undesirable image data deletion in despite of poor printing quality. This contributes to more reliable facsimile communication.

Third Embodiment

Note that the second embodiment uses the A/D converter 28 to perform high-speed sampling of the output from the photosensor 8, however, the present invention is not limited to this arrangement. The A/D converter 28A can be replaced by, e.g., a comparator using a cheaper OP-amplifier.

Figure 12:
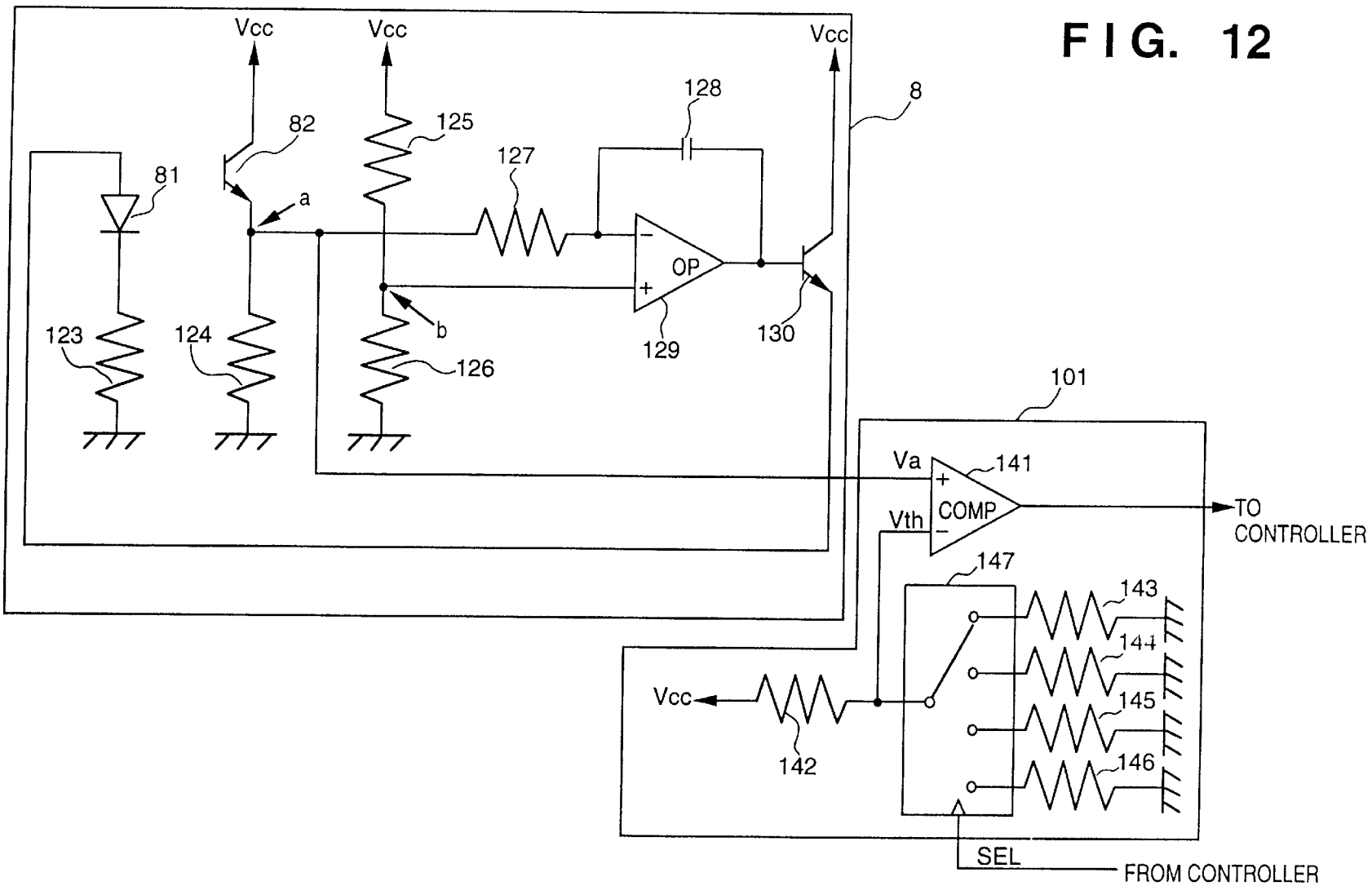
FIG. 12 is a block diagram showing constructions of the photosensor 8 and a comparator 101, according to a third embodiment of the present invention.

FIG. 12 shows a construction of the photosensor 8 and that of the comparator 101, according to a third embodiment of the present invention.

In FIG. 12, numeral 81 denotes an infrared LED as the light-emission device; 82, a photo-transistor as the photo-reception device; 123 to 127 resistors; 128, a capacitor; 129, an OP-amplifier (OP); 130, a transistor; 141, a comparator (COMP); 142 to 146, resistor for determining a threshold value used by the comparator 141; and 147, a selector.

The OP-amplifier 129 supplies base current to the transistor 130 such that a potential (at a point a) on the emitter side of the photo-transistor 82 becomes equal to a potential (at point b) determined by a power-source voltage Vcc and the resistors 125 and 126. This circuit construction can eliminate influence of time variation or variation of quality of devices such as the infrared LED 81 and the photo-transistor 82, and can perform more stable ink-discharge status detection.

If the amount of light from the infrared LED 81 decreases and light current that flows through the photo-transistor 82 decreases, the potential at the point a decreases. On the other hand, as the OP-amplifier 29 increases the base current to the transistor 130, the current at the infrared LED 81 increases, as a result, the potential at the point a and that at the point b become equal to each other. The time required for the point where the potentials at the points a and b coincide is set by a time constant determined by the capacitor 128 and the resistor 127. Accordingly, so far as a large value is taken as the time constant, current control for the infrared LED 81 with respect to an instantaneous change of the quantity of light can be ignored.

Upon ink-discharge status detection, light from the infrared LED 81 is interrupted by discharging ink between the infrared LED 81 and the photo-transistor 82, as shown in FIG. 5. Then the light current generated by the photo-transistor 82 decreases, and the potential at the point a decreases. On the other hand, if ink discharge is stopped or ink is exhausted, the light current generated by the photo-transistor 82 increases again, and the potential at the point a increases again, to the initial value. In this manner, existence/absence of ink can be detected by change of potential at the point a.

The selector 147 selects one of the resistors 143 to 146, used for determining a threshold value, in accordance with a selection signal (SEL) from the controller 24. Accordingly, the voltage value, determined by the power-source voltage Vcc, the resistor 142 and the selected resistor, is inputted, as a threshold value (Vth), into a negative terminal (−) of the comparator 141. The comparator 141 compares the voltage value (Va) at the point a inputted against a positive terminal (+) with the threshold value (Vth). If Va≦Vth holds, the comparator 141 outputs a signal at a "Low" level, while if Va>Vth holds, the comparator 141 outputs a signal at a "High" level.

Figure 13:
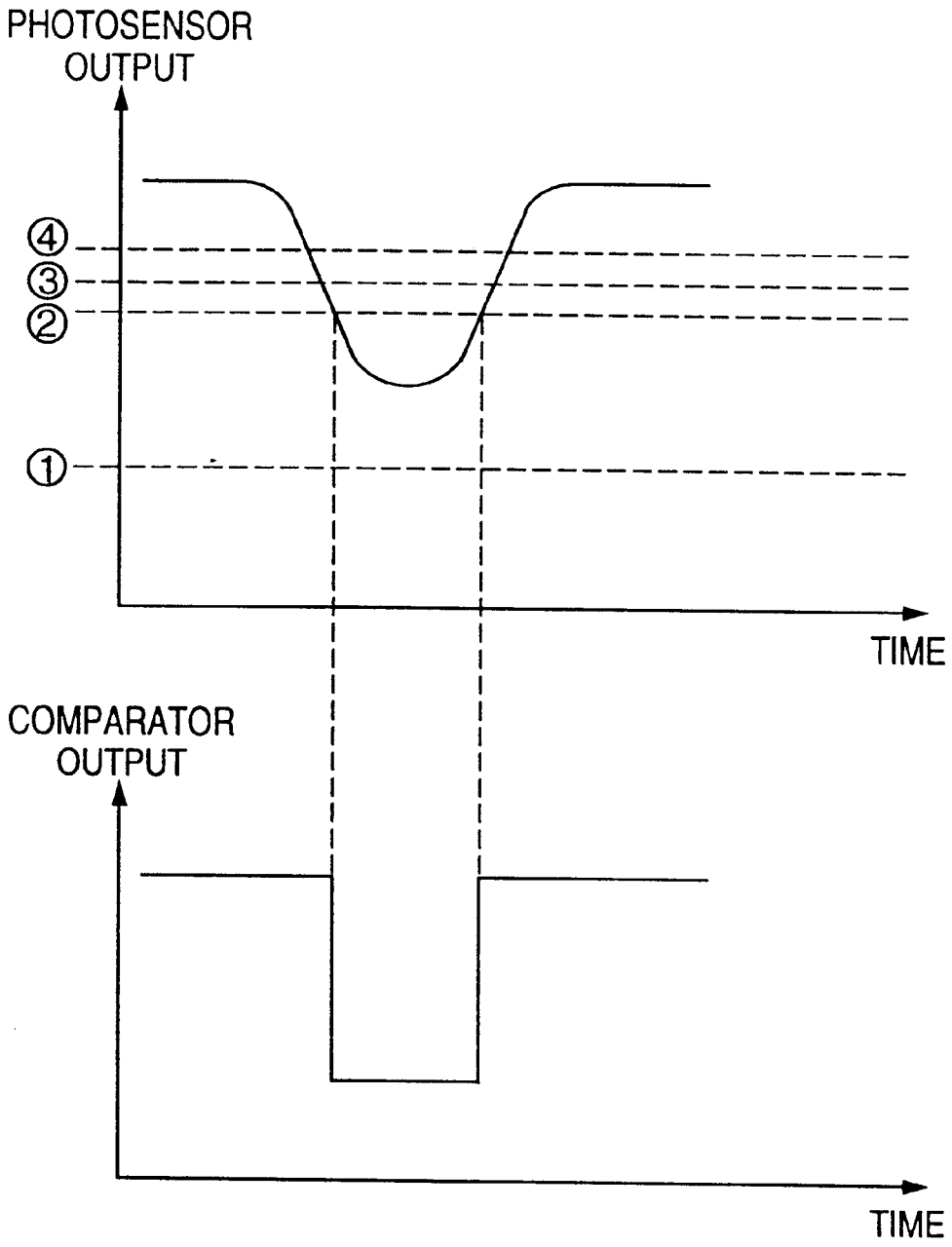
FIG. 13 is an explanatory view showing the relation among output from the photosensor 8, threshold values for a comparator 141, and output from the comparator 141.

FIG. 13 shows the relation among output from the photosensor 8, threshold values for the comparator 141 and output from the comparator 141. As shown in. FIG. 13, the threshold value of the comparator 141 can be selected from threshold values ① to ④ by selecting one. of the resistors 143 to 146. For example, when ink-discharge status detection with respect to black ink is performed, the control signal (SEL) is inputted so that the threshold value ① is selected; when ink-discharge status detection with respect to cyan ink is performed, the control signal (SEL) is inputted so that the threshold value ② is selected; when ink-discharge status detection with respect to magenta ink is performed, the control signal (SEL) is inputted so that the threshold value ③ is selected; and when ink-discharge status detection with respect to yellow ink is performed, the control signal (SEL) is inputted so that the threshold value ④ is selected.

FIG. 13 shows the output from the comparator 141 in a case where the voltage value (Va) at the point a as the output from the photosensor 8 is compared with the threshold value ②. In this case, if the threshold ① is selected, the output from the comparator 141 is always at the "High" level.

In actual ink-discharge status detection, the controller 24 selects a threshold value for the comparator 24 by the selection signal (SEL), in accordance with the color of ink to be the object of ink-discharge status detection.

Then, the carriage 15 holding the printhead 5 is moved at a position around the photosensor 8, and is moved while ink is discharged so that the ink interrupts between the infrared LED 81 and-the photo-transistor 82. At this time, the controller 24 monitors the output from the comparator 141. If the output is at the "Low" level for a predetermined period or longer, it judges that ink remains, while if the duration of the "Low" level output status is shorter than the predetermined period, it judges that ink is exhausted. This operation is performed for each ink.

According to the present embodiment, ink-discharge status detection can be performed by using different threshold values for the respective color ink, with a cheaper comparator.

Note that print modes as described in the above embodiment have not been considered, however, the present embodiment can deal with different print modes by providing the selector 147 to select one of eight resistors, i.e., by generating eight threshold values.

Figure 14:
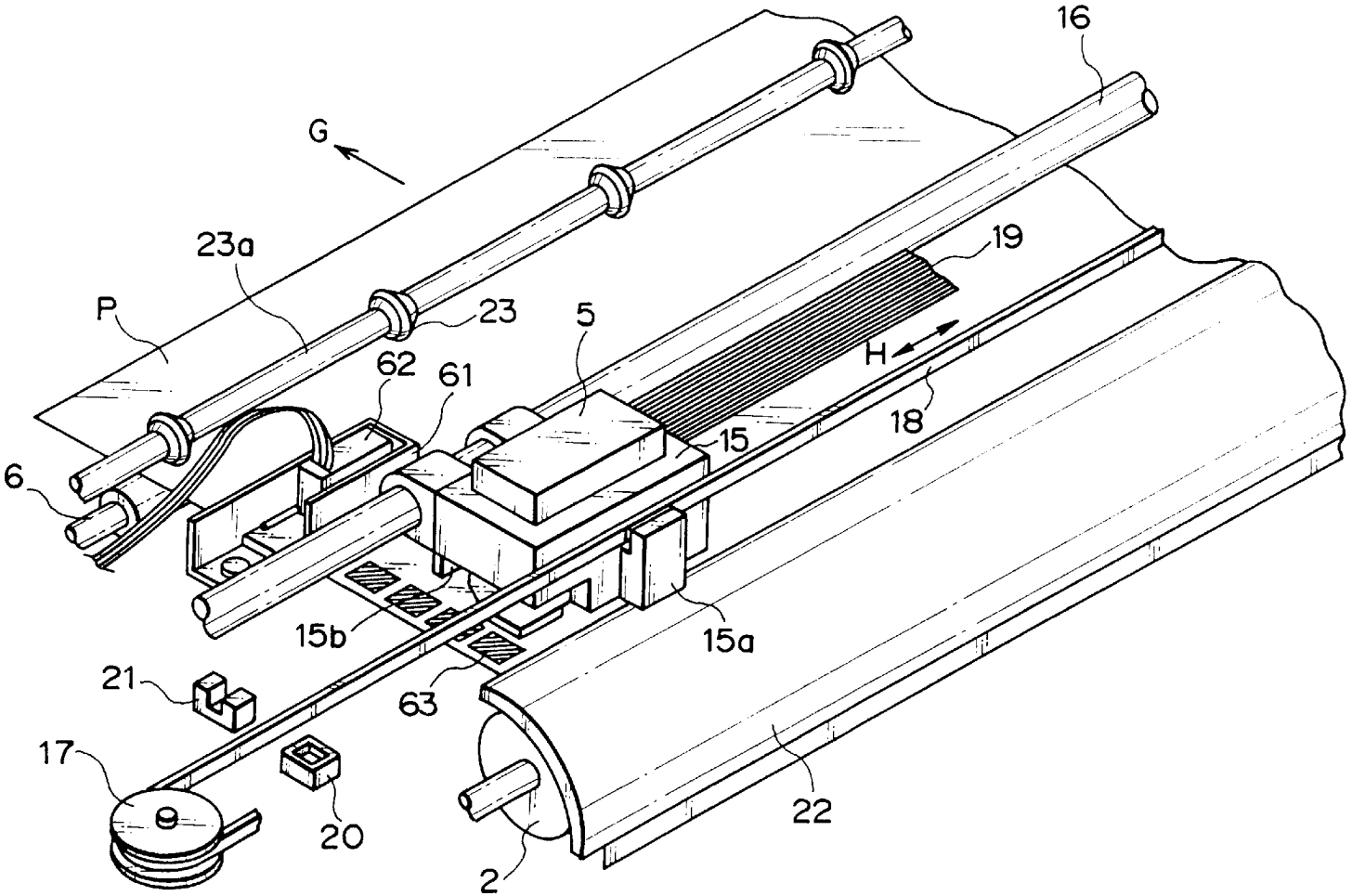
FIG. 14 is a perspective view showing a modified structure of the printer B of the facsimile apparatus in FIG. 1.
Figure 15:
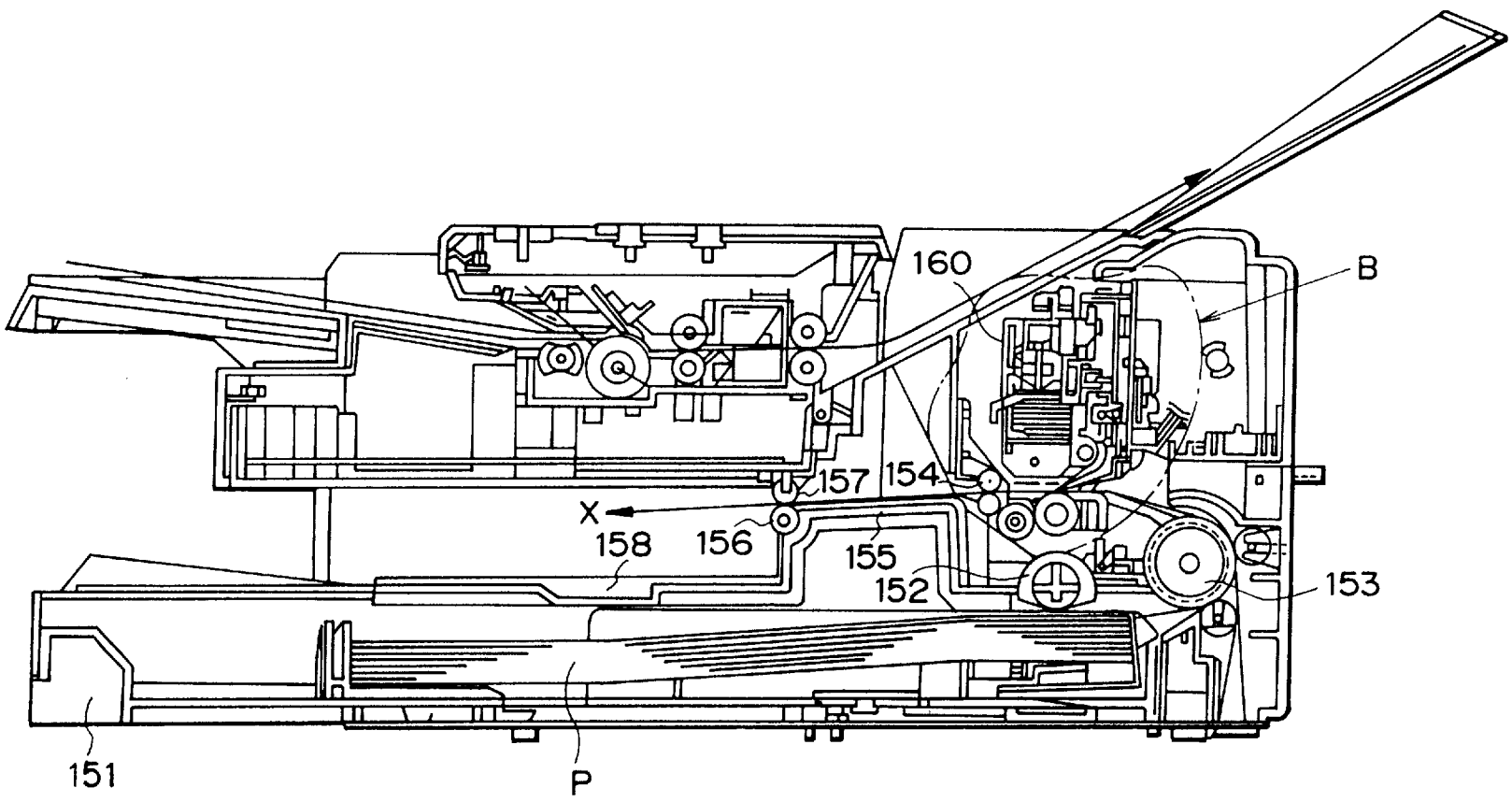
FIG. 15 is a cross-sectional view showing a structure of the conventional facsimile apparatus.

Further, in the above construction, ink-discharge status detection is performed by using the photo-interruptive type photosensor 8 provided around the home position of the carriage, however, the present invention is not limited to this arrangement. For example, as shown in FIG. 14, it may be arranged such that a photo-reflective type photosensor 62 is provided at a position opposite to a print surface of a print medium, and after the completion of printing for each page, the photosensor 62 irradiates light on the left end of the print sheet P. From light reflected from the print sheet P, a mark 63 printed at a predetermined position can be optically detected. The photosensor 62 may use, e.g., an infrared LED as a light-emission device and a photo-transistor as a photoreception device, to discriminate ink density where the mark 63 is printed, within a range having a diameter of approximately 3 mm.

Further, upon color printing, a mark of about 5×5 mm is printed on the left end of the print sheet P, in each color ink, at the same position in a main-scanning direction, and at slightly shifted positions in a subscanning direction. As the print sheet P is conveyed in the subscanning direction, the photoreception device of the photosensor 63 detects the density of the marks in the respective colors. Note that as an output characteristic of the photo-transistor differs in print modes and color ink, it is apparent that threshold values corresponding to the respective print modes and respective colors are required.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the a ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive an ink from the apparatus main unit upon being mounted on the apparatus main unit or a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices or to an apparatus comprising a single device.

Furthermore, the invention is also applicable to a case where the invention is embodied by supplying a program to a system or apparatus. In this case, a storage medium, storing a program according to the invention, constitutes the invention. The system or apparatus installed with the program read from the medium realizes the functions according to the invention.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for printing by using a printhead having plural nozzle groups, each of which is a nozzle array having plural nozzles, respectively corresponding to plural colors, comprising:

scanning means for scanning said printhead:

detection means, having a light-emission device and a photoreception device, for optically detecting ink discharge status indicating whether there is ink discharge or not when performing ink discharge operation from the nozzles of said printhead; and control means for controlling detection operation such that said direction means sequentially detects the ink discharge status of each of the plural nozzle groups;

wherein said detection means detects the ink discharge status of each of the plural nozzle groups based on an output of the photoreception device and one of plural thersholds respectively corresponding to the plural nozzle groups.

2. The apparatus according to claim 1, wherein said light-emission device includes an infrared LED.

3. The apparatus according to claim 1, wherein said photoreception device includes a phototransistor which generates an electric signal based on the light received by said photoreception device.

4. The apparatus according to claim 1, wherein an optical axis connecting said light-emission device and said photoreception device is parallel to the nozzle array of said printhead for discharging ink.

5. The apparatus according to claim 1, wherein a length of the nozzle array is shorter than a distance between said light-emission device and said photoreception device.

6. The apparatus according to claim 1, wherein said printhead is an ink-jet printhead which discharges ink by utilizing thermal energy, and comprises electrothermal transducers for generating thermal energy to be supplied to ink.

7. A facsimile apparatus using a printing apparatus claimed in claim 1, and further comprising:

reception means for receiving image information transmitted via a communication line;

memory means for storing image information received by said reception means; and second control means for controlling said control means to perform the detection operation after completion of each image printing, based on the image information received by said reception means, for one page of print medium.

8. The apparatus according to claim 7, further comprising memory control means for holding or deleting the image information stored in said memory means, in accordance with the result of ink-discharge status obtained form the detection operation by said detection means.

9. An ink discharge status detection method adopted to a printing apparatus for printing by using a printhead having plural nozzle groups, each of which is a nozzle array having plural nozzles, respectively corresponding to plural colors, comprising the steps of:

scanning said printhead;

optically detecting ink discharge status indicating whether there is ink discharge or not when performing ink discharge operation from the nozzles of said printhead, by using a light-emission device and a photoreception device; and controlling detection in said detecting step such that the ink discharge status of each of the plural nozzle groups is sequentially detected;

wherein in said detecting step, the ink discharge status of each of the plural nozzle groups is detected based on an output of the photoreception device and one of plural thresholds respectively corresponding to the plural nozzle groups.

10. The method according to claim 9, wherein said light-emission device includes an infrared LED.

11. The method according to claim 9, wherein said photoreception device includes a phototransistor which generates an electric signal based on the light received by said photoreception device.

12. The method according to claim 9, wherein an optical axis connecting said light-emission device and said photoreception device is parallel to the nozzle array of said printhead for discharging ink.

13. The method according to claim 9, wherein a length of the nozzle array is shorter than a distance between said light-emission device and said photoreception device.

14. The method according to claim 9, wherein said printhead is an ink-jet printhead which comprises electrothermal transducers generating thermal energy to be supplied to ink.

* * * * *

UNITED STATES PATENT AND TRADEMARK OFFICE

CERTIFICATE OF CORRECTION

PATENT NO. : 6,419,341 B1
DATED : July 16, 2002
INVENTOR(S) : Yukio Nohata et al.

It is certified that error appears in the above-identified patent and that said Letters Patent is hereby corrected as shown below:

Title page,
Item [30], Foreign Application Priority Data, "Feb. 10, 1995" should read -- Oct. 2, 1995 --; and "June 3, 1996" should read -- Mar. 6, 1996 --.
Item [56], References Cited, U.S. PATENT DOCUMENTS, "4,558,333" should read -- 4,458,333 --.

Column 2,
Line 46, "in;" should read -- ink --.

Column 3,
Line 51, "in" should be deleted.

Column 6,
Line 10, "it" should read -- it is --;
Line 18, "remain" should read -- remains --;
Line 49, "fourths" should read -- fourth --; and
Line 56, "moded" should read -- mode --.

Column 8,
Line 41, "invention" should read -- invention will --.

Column 10,
Line 14, "to" should read -- to the --; and
Line 47, "irradiates" should read -- irradiate --.

Column 11,
Line 25, "eliminating-unset" should read -- eliminating unset --.

Column 16,
Line 32, "colored" should read -- colors --.

Column 17,
Line 47, "11B" should read -- 11B. --.

Column 18,
Lines 62 and 63, "ink" should read -- inks --.

Column 19,
Lines 65 and 66, "ink" should read -- inks --.

UNITED STATES PATENT AND TRADEMARK OFFICE

CERTIFICATE OF CORRECTION

PATENT NO. : 6,419,341 B1
DATED : July 16, 2002
INVENTOR(S) : Yukio Nohata et al.

It is certified that error appears in the above-identified patent and that said Letters Patent is hereby corrected as shown below:

Column 20,
Line 10, “store” should read -- stored --; and
Line 13, “in” should be deleted.

Column 21,
Line 13, “in.” should read -- in --;
Line 14, “one.” should read -- one --; and
Line 38, “and-the” should read -- and the --.

Column 22,
Line 23, “a” should be deleted.

Column 24,
Line 16, “printhead:” should read -- printhead; --;
Line 23, “direction” should read -- detection --;
Line 28, “thersholds” should read -- thresholds --; and
Line 63, “form” should read -- from --.

Signed and Sealed this

Eleventh Day of March, 2003

JAMES E. ROGAN
*Director of the United States Patent and Trademark Office*